US007350910B2

(12) United States Patent
Amma et al.

(10) Patent No.: US 7,350,910 B2
(45) Date of Patent: Apr. 1, 2008

(54) LIQUID CONTAINER AND INK JET RECORDING APPARATUS

(75) Inventors: Hiromasa Amma, Kawasaki (JP); Yasuo Kotaki, Yokohama (JP); Keisuke Matsuo, Yokohama (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 11/250,467

(22) Filed: Oct. 17, 2005

(65) Prior Publication Data

US 2006/0087538 A1 Apr. 27, 2006

(30) Foreign Application Priority Data

Oct. 20, 2004 (JP) ..... 2004-306128
Dec. 22, 2004 (JP) ..... 2004-371495

(51) Int. Cl.
*B41J 2/175* (2006.01)
*B41J 29/393* (2006.01)

(52) U.S. Cl. ..... 347/86; 347/19

(58) Field of Classification Search ..... 347/7, 347/19, 86; 250/577
See application file for complete search history.

(56) References Cited

U.S. PATENT DOCUMENTS 4,287,427 A * 9/1981 Scifres ..... 250/577
5,616,929 A 4/1997 Hara ..... 250/573
5,689,290 A * 11/1997 Saito et al. ..... 347/7
6,012,795 A * 1/2000 Saito et al. ..... 347/7
6,097,405 A 8/2000 Lo et al. ..... 347/6
6,302,535 B1 10/2001 Sturgeon et al. ..... 347/86
6,422,675 B1 * 7/2002 Tomomatsu ..... 347/7
6,454,400 B1 9/2002 Morita et al. ..... 347/86
6,869,158 B2 3/2005 Kojima et al. ..... 347/19
2005/0219303 A1 10/2005 Matsumoto et al. ..... 347/19
2006/0082625 A1 4/2006 Kotaki et al. ..... 347/86
2006/0139384 A1 6/2006 Kitabataki et al. ..... 347/7

FOREIGN PATENT DOCUMENTS

JP 4-275156 9/1992
JP 7-218321 8/1995
JP 8-1958 1/1996
JP 2002-301829 10/2002

* cited by examiner

*Primary Examiner*—Anh T. N. Vo
(74) *Attorney, Agent, or Firm*—Fitzpatrick, Cella, Harper & Scinto

(57) ABSTRACT

A liquid container for accommodating liquid for use with an ink jet recording apparatus includes a light emitting portion; an electric contact for receiving a signal for actuating said light emitting portion from the ink jet recording apparatus; and a light guide portion for guiding the light from said light emitting portion to a display portion which displays information by the light which is emitted from said light emitting portion and which emerges from said display portion.

15 Claims, 27 Drawing Sheets

(a)

(b)

LIQUID CONTAINER AND INK JET RECORDING APPARATUS

FIELD OF THE INVENTION AND RELATED ART

The present invention relates to a liquid container, more particularly to a liquid container usable with a structure wherein a state of liquid container such as a remaining ink amount in the ink container is notified by light emitting means such as LED.

With recent wide use of digital camera or the like, there is increasing demand for the printing through direct connection between the digital camera and a recording device without a personal computer (PC) (non-PC printing). The printing with direct connection of the digital camera with a printer is called "camera direct printing" Another increasing demand is for the printing by direct mounting of an information memory medium of a card type on a printer, the information memory medium being detachably mountable on the digital camera (non-PC printing). This is called "card direct printing" In addition, a so-called multi-function printer integrally having a printer mechanism and a scanner mechanism and therefore having a copying function without use of a PC, and further having the direct printing function without use of a PC.

In an ink jet printer, it may desirable or is demanded by a user that information on the state of the ink container such as a mounting state or remaining ink amount of the ink container, for example, is notified to the user. For example, if the user is aware of shortage of the remaining ink amount in the ink container in use, the user can exchange the ink container with a fresh one before the user starts printing. By doing so, the trouble that printing is deffective due to the ink container becoming empty during a printing operation with the result of waste of the recording material can be avoided beforehand.

Heretofore, such information is transmitted too a PC connected with the printer, and the event is displayed on the computer display, thus notifying the user of the event. When the so-called non-PC printing is used, it would be considered that display is provided on the main assembly of the printer to display the event or information. However, the provision of the display results in increase in cost and size of the printer, and in addition, the design of the printer would be adversely affected, and for this reason, it is not always desirable to provide a display on the main assembly of the printer. Even if a display is provided, it does not mean that user can be given a very clear indication.

Use of LED is known to notify the user of a state of the ink container. Japanese Laid-open Patent Application Hei 4-275156 discloses the provision of two LEDs on an ink container which is integral with the recording head, wherein the LEDs are lit on in two patterns indicative of two levels of the remaining ink amount. More particularly, the use is made with means, provided on the ink cartridge which is integral with the ink container, for counting the number of electric power supplies to the ink jet head. Further, the use is made with means for storing the count, a LED for near end display which is lit on when an integrated count reaches a predetermined near end discrimination value and an ink empty LED which is lit on when the ink empty discrimination value is reached. With this structure, the state of the ink container can be notified to the user.

Similarly, Japanese Laid-open Patent Application 2002-301829 discloses that lamp is provided on an ink container or on a carriage for carrying it and the lamp which lights on in accordance with the remaining ink amount. It also discloses that of four ink containers is provided with a lamp.

On the other hand, in order to meet the demand for a higher image quality, light magenta ink and/or light cyan ink are used in addition to the conventional four color inks (black, yellow magenta and cyan). Furthermore, use of so-called particular color ink such as red ink, green ink or blue ink. In such a case, seven to nine ink containers are mounted on the ink jet printer. Then, a mechanism for preventing the ink containers from being mounted at erroneous positions is desired. U.S. Pat. No. 6,302,535 discloses that engaging configurations of the carriage, the ink containers are made different from each other, so that erroneous mounting (incorrect position) is prevented, when the ink containers are mounted on the carriage.

Above-discussed Japanese Laid-open Patent Application Hei 4-275156 discloses a structure of the ink cartridge wherein a LED for display is mounted on a print circuit board for electrical communication with the main assembly of the printer. However, with such a structure, in order to place the LED at a position allowing easy observation by the user, the PC plate has to be placed at the same to position. Since the PC plate includes electrical connecting portion for electrical communication with the main assembly of the printer, the latitude of the arrangement is limited. It would be considered the use is made with a large area PC plate to cover both the preferable position of the electrical connecting portion and the preferable portion of the LED. However, doing so increases the cost. If the structure disclosed in Japanese Laid-open Patent Application Hei 4-275156 is incorporated in a printer which carries a plurality of independent ink containers for the respective colors, the structure for mounting the ink container to the printer is limited, and therefore, the substantive capacity of the ink container has to be reduced, or the printer has to be upsized.

On the other hand, Japanese Laid-open Patent Application 2002-301829 simply discloses that ink warning lamp is provided at such a position that user easily recognizes it. However, it does not disclose a preferable structure for supplying the electric power or the signal to the ink warning lamp. From FIG. 6-FIG. 8 of Japanese Laid-open Patent Application 2002-301829, a lead wire connecting the ink jet recording apparatus and the ink warning lamp is suggested. But a number of wiring leads corresponding to the number of ink warning lamps are necessitated with the result of complicated wiring and therefore cost increase, and in addition, the wiring lead and the connecting portion will deteriorate the easy observation. With this structure, however, a number of wiring leads corresponding to the number of ink warning lamps are necessitated with the result of complicated wiring and therefore cost increase, and in addition, the wiring lead and the connecting portion will deteriorate the easy observation. In addition, Japanese Laid-open Patent Application 2002-301829 discloses in its FIGS. 6 and 8 that ink warning lamp is provided on a fixed lever which is a movable member for fixing the ink container on the carriage for carrying the ink container. However, with such a structure, the arrangement of the lead wire is complicated, and therefore, the cost is high, and in addition, the operationality in the mounting and demounting of the ink container may be poor.

These problems are more significant recently as a result of the tendency toward downsizing and multi-function. Particularly in the case of a multi-function printer in which a scanner is placed at the top of the printer, the position for the display is more limited, and therefore, it is desired to satisfy both of viewability and operationality.

The display is used not only to notify the user of the information but also to permit proper control of the main assembly side of the apparatus.

The consideration will be made as to the case wherein a lamp is provided on an ink container as disclosed in Japanese Laid-open Patent Application 2002-301829. The main assembly side controller has to identify the ink container which is recognized as containing less ink. To do this, it is necessary to identify the ink container to which the signal for turning the lamp on is to be sent. If, for example, the ink container is mounted on a wrong position, there is a liability that information of the small amount of the remaining ink is displayed for another ink container which contains a sufficient amount of the ink. Therefore, for the emission control of the displaying device such as a lamp or the like, it is a premise that positions of the ink containers are correctly known.

As for the structure for specifying the mounted positions of the ink containers, U.S. Pat. No. 6,302,535 discloses that configurations of the engaging positions of ink containers are made different depending on the colors of the ink containers. However, in such a case, it is required that ink containers having configurations depending on the colors of the ink to contain have to be manufactured, with the result of disadvantage in the manufacturing cost which is more significant with the increase of the number of the colors of the ink.

It would be possible that light emission control is carried out for each of the LEDs of the ink containers, and the emitted light is received by a photoreceptor fixed in the printer, wherein on the basis of the state of the output, the position of the ink container is identified. With such a structure, the LED of the ink container has two functions, namely, to emit the light to the photoreceptor to notify the user of the state of the ink container and to emit the light to specify the position of the ink container.

Here, the user possibly looks at display portion of the ink container in the printer in various directions. In view of the fact, it is desirable to emit the light in a wide range. On the other hand, the photoreceptor provided fixed in the printer, and therefore, the positional relation relative to the display portion of the ink container at the time of detection is substantially predetermined. From this standpoint, therefore, the display portion desirably directs the light in the range as small as possible although the range has to cover the mounting tolerance of the photoreceptor in the printer, since then the light intensity is high to assure a light quantity enough for the photoreceptor. Thus, the display portion is required to satisfy these contradictory functions.

Accordingly, it is a principal object of the present invention to provide an ink container, a recording or printing apparatus and a recording or printing system wherein both of the operationality and the viewability are satisfactory.

It is another object of the present invention to provide an ink container, a recording or printing apparatus or a recording or printing system wherein both of the viewability by the user and the stability of the light quantity received by the light receiving portion are satisfied.

According to an aspect of the present invention, there is provided a liquid container for accommodating liquid for use with an ink jet recording apparatus, said container comprising a light emitting portion; an electric contact for receiving a signal for actuating said light emitting portion from the ink jet recording apparatus; and a light guide portion for guiding the light from said light emitting portion to a display portion which displays information by the light from said light emitting portion emerging therefrom.

According to another aspect of the present invention, said bending portion is an inclined surface of said light guide portion provided at an end thereof opposite from an end for receiving the light from said light emitting portion.

According to a further aspect of the present invention, said light guide portion comprises a part extending in a predetermined direction and a part extending in a direction different from the predetermined direction.

According to a further aspect of the present invention, said ink jet recording apparatus includes means for imparting a relative movement between said liquid container and a light receiving portion for receiving the light emergent from said display portion, and wherein the scanning direction is the same as the predetermined direction.

The liquid container of the present invention is usable to liquid ink, and the present invention is also directed to an ink jet recording apparatus capable of printing using the liquid container as an ink supply source.

According to the present invention, the light emission source and the display portion are separated, and they are interconnected through a light guide which is provided on the liquid container. This eliminates wiring lead or the like for the purpose of electric power supply or signal exchange, which adversely affects the viewability and the operationality. According to this feature, the light emission source and the display portion can be disposed inexpensively at respective positions which are optimum, respectively. By doing so, the latitude of the position of the display portion is assured, and therefore, the user can easily and assuredly notified of the predetermined information relating to the liquid container.

In addition, by bending the optical axis by reflecting the light by an inclined surface of the light guide portion, for example, the emerging direction of the light can be controlled so that light can be assuredly directed to the display portion positioned for the viewing convenience.

The feature that the light guide portion comprises a part extending in a predetermined direction and a part extending in a direction different from the predetermined direction, is effective to accomplishes a structure which satisfies both the viewability by the user and the stability of the light quantity received by the light receiving portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the preferred embodiment of the present invention in conjunction with the accompanying drawings.

1. First Embodiment

1.1 Description of the First Embodiment

Figure 1:
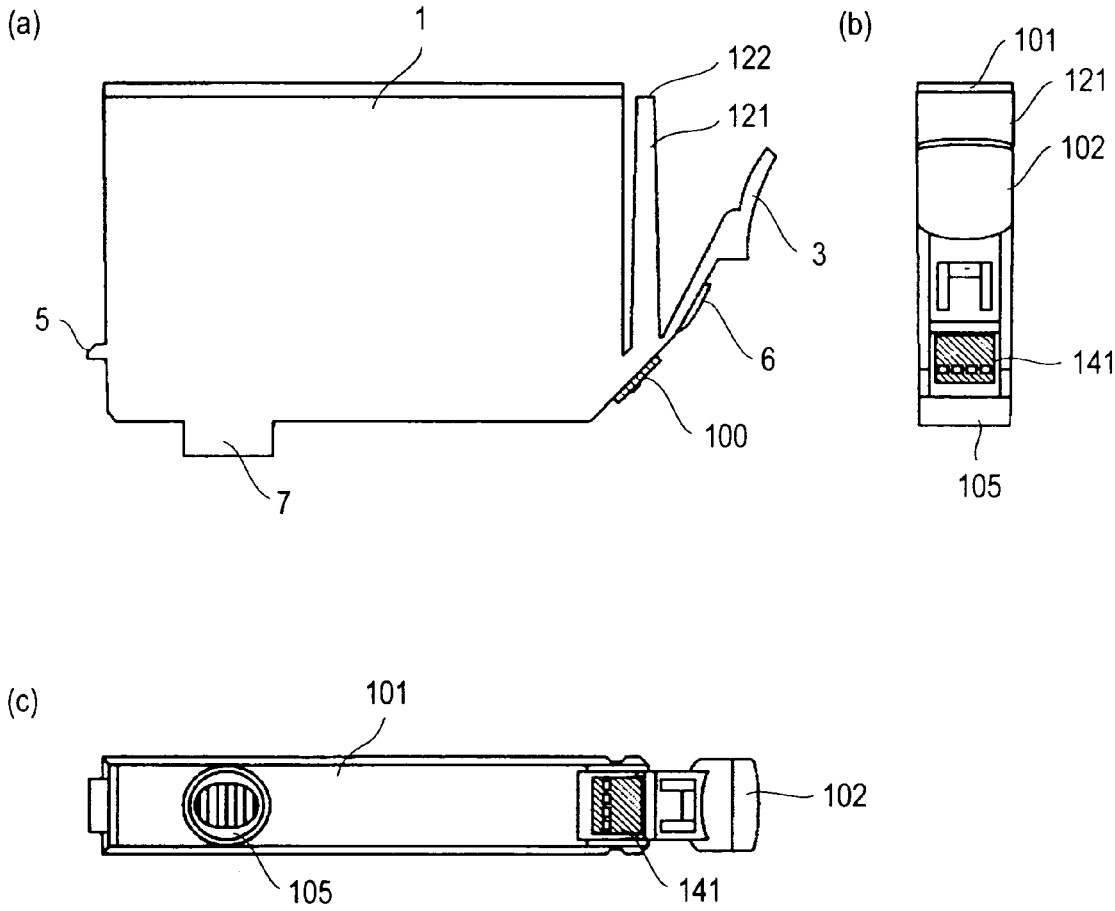
FIG. 1 is a side view (a), a front view (b) and a bottom view (c) of an ink container according to a first embodiment of the present invention.

FIG. 1 is a side view (a), a front view (b) and a bottom view (c) of an ink container according to a first embodiment of the present invention. In the following descriptions, the front side of the ink container is the side which is faced to the user who is manipulating the ink container (mounting and demounting operation of the ink container), which provides the user with information (by light emission from a display portion which will be described hereinafter).

In FIG. 1, the ink container 1 of this embodiment has a supporting member 3 supported on the lower portion at the front side thereof. The supporting member 3 is made of resin material integrally molded with an outer casing of the ink container 1, and the ink container 1 is displaceable about a portion of the ink container to be supported when the ink container 1 is mounted to the container holder. The ink container 1 is provided on its rear side and front side with a first engaging portion 5 and second engaging portion 6, respectively, which are engageable with locking portions provided in a container holder. In this embodiment, they are integral with the supporting member 3. By engagement of the engaging portion 5 and the engaging portion 6 with the locking portions, the ink container 1 is securedly mounted in the ink container 1. The operation during the mounting will be described hereinafter referring to FIG. 12, (a)-(c).

The bottom surface of the ink container 1 is provided with an ink supply port 7 for ink supply, which port is connectable with an ink introduction opening of the recording head which will be described hereinafter, by mounting of the ink container 1 to the container holder. A base member is provided on the bottom side of the supporting portion of the supporting member 3 at a position where the bottom side and the front side intersect with each other. The base member may be in the form of a chip or a plate. In the following description, it is called "substrate" 100.

Figure 2:
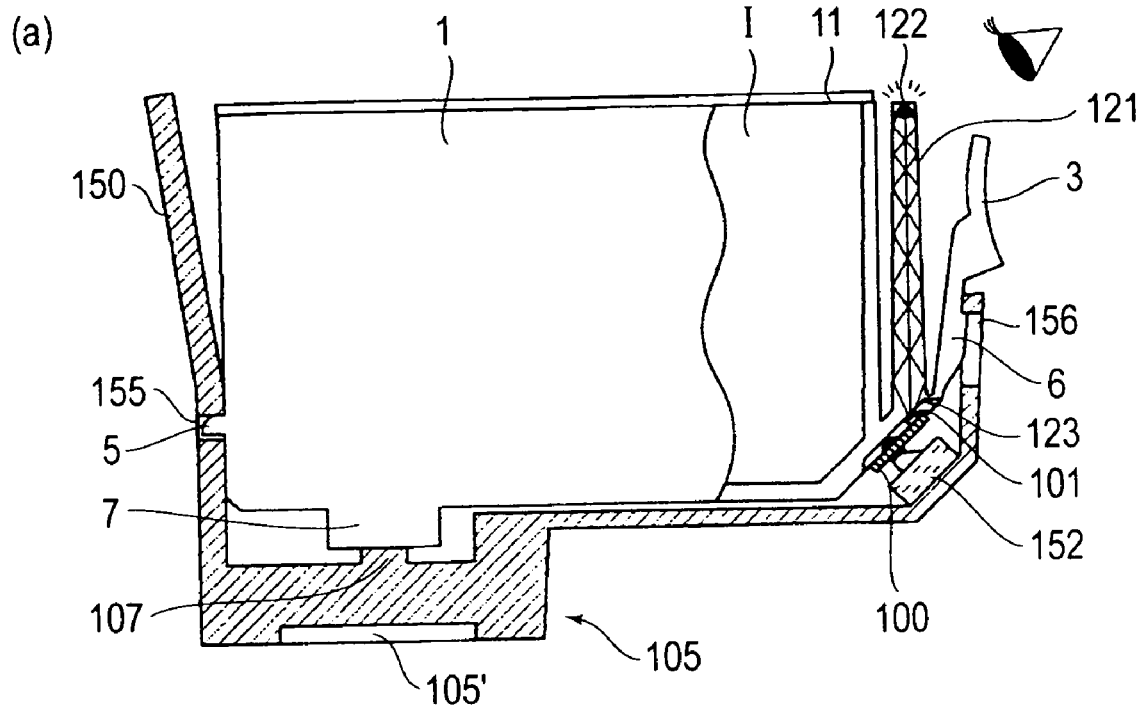
FIG. 2 is a schematic side view (a) and an enlarged view (b) of a major part thereof, illustrating functions of light guide portion and the like provided on the ink container according to the first embodiment of the present invention.
Figure 2:
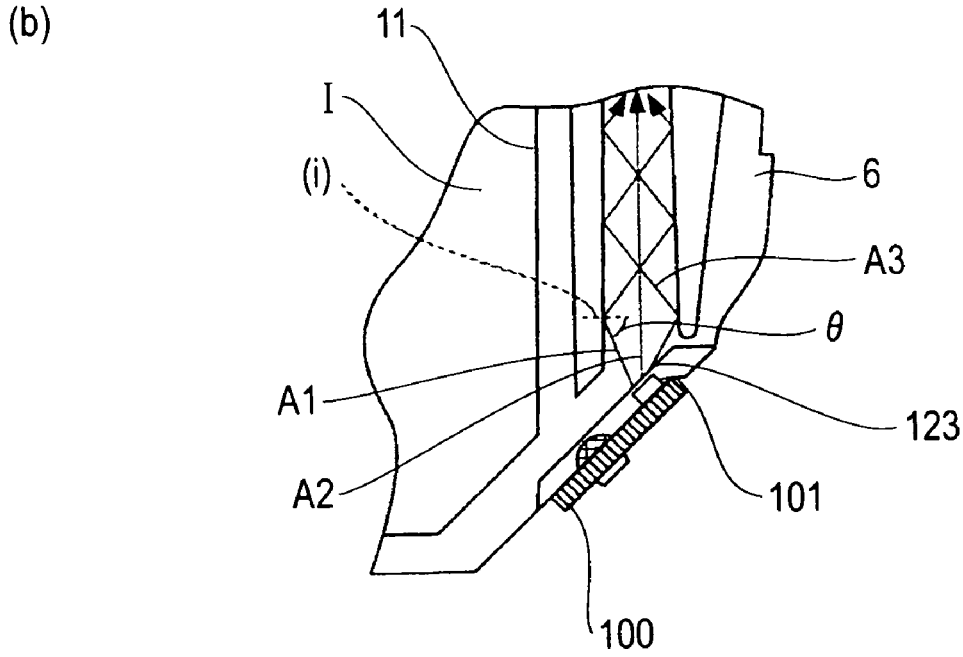
Figure 3:
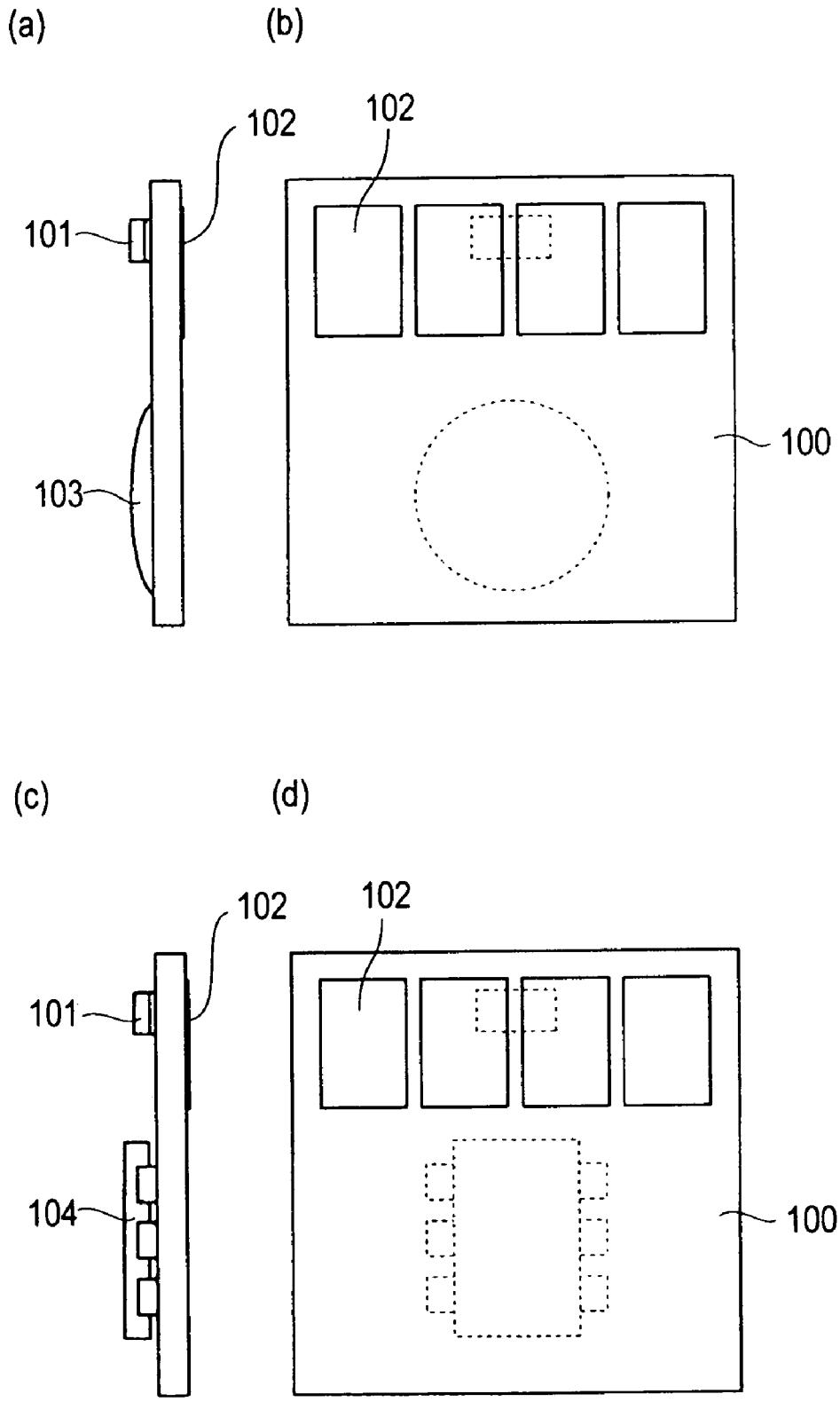
FIG. 3 is a side view (a) and a front view (b) of an example of a controller substrate mounted on the ink container of the first embodiment, and a side view (c) and front view (d) of another example of a controller substrate.

Referring to FIG. 2, (a) and (b) and FIG. 3, (a)-(d), the description will be made as to a structure and a function of a major part of this embodiment. FIG. 2 is a schematic side view (a) and an enlarged view (b) of a major part thereof, illustrating functions of light guide portion and the like provided on the ink container according to the first embodiment of the present invention. FIG. 3 is a side view (a) and a front view (b) of an example of a controller substrate mounted on the ink container of the first embodiment. FIG. 3, (c) and (d) are a side view and a front view of a controller substrate 100 of another example.

As shown by (a) in FIG. 2, (a), the ink container 1 is securedly mounted in or to the holder 150 which is integral with the recording head unit 105 having the recording head 105', by engagements of the first engaging portion 5 and the second engaging portion 6 of the ink container 1 with a first locking portion 155 and a second locking portion 156 of the holder 150, respectively. At this time, a contact (connector) 152 provided in the holder 150, and a contact in the form of an electrode pad 102 ((b) of FIG. 3) provided on a surface of the substrate 100 facing to outside, are electrically contacted to establish electrical connection therebetween.

An inside of the ink container 1 is divided into an ink reservoir chamber 11 which is provided adjacent the front side c, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid communication with each other through a communication port 13. The ink reservoir chamber 11 contains the ink alone in this embodiment, whereas the negative pressure generating member accommodating chamber 12 accommodates an ink absorbing material 15 (negative pressure generating member which is a porous member in this embodiment) made of sponge, fiber aggregate or the like for retaining the ink by impregnation. The porous member 15 functions to generate such a negative pressure as is sufficient to provide balance with the force of meniscus formed in the ink ejection nozzle of the recording head to prevent ink leakage from the ink ejection portion to the outside and to permits ink ejection by actuation of the recording head.

The internal structure of the ink container 1 is not limited to such a partitioned structure in which the inside is partitioned into the porous member accommodating chamber and the reservoir containing the ink alone. In another example, the porous member may occupy substantially the entire inner space of the ink container. The negative pressure generating means is not limited to the one using the porous member. In another example, the ink alone is contained in a bladder-like member made of elastic material such as rubber or the like which produces tension in the direction of expanding the volume thereof. In such a case, the negative pressure is generated by the tension in the bladder-like member to retain the ink. In a further example, at least a part of the ink accommodation space is constructed by a flexible member, and the ink alone is accommodated in the space, wherein a spring force is applied to the flexible member, by which a negative pressure is generated.

As shown in FIG. 3, (a) and (b), the surface of the substrate 100 facing toward the ink container 1, is provided with an emitting portion 101 for emitting visible light such as a LED, and a control element 103 for controlling the emitting portion. The control element 103 controls emission of light of the emitting portion 101 in response to an electric signal supplied through a pad 102 from a connector 152.

FIG. 3, (a) and (b) shows a state in which after the control element 103 is mounted on the substrate 100, it is coated with a protecting sealant. When a memory element for storing information such as a color or the remaining amount of the ink contained in the ink container is employed, it is set at the same place, so that it is coated with the sealant. As shown in FIG. 3, (c) and (d), the control element 104 in the form of a package may be mounted. With such a structure, the light emission element and the control element are simultaneously mounted on the substrate, so that manufacturing step can be simplified.

As shown in FIG. 2, (a) and (b), a light guide portion 121 extends upwardly with a clearance from a front side wall of the outer casing of the ink container from a position where it is faced to the emitting portion 101, and is effective to guide the light. The free end portion thereof constitutes a display portion 122 which is easily seen by the user. In order to suppress attenuation of a light quantity in the travel of light from the emitting portion 101 to the light guide portion 121, the emitting portion 101 is disposed on the substrate 100 so as to face a light incident surface 123 of the light guide portion 121 at a position close thereto (FIG. 2, (b)).

The light emitting portion and the display portion are separated from each other, and the light guide portion 121 is provided on the ink container 101 to connect them optically, so that electric wiring leads or the like for the electric power supply and for signal exchange is not necessitated, and therefore, the possible deterioration due to the wiring leads to the viewability and the operationality can be avoided. In addition, the light emitting portion 101 and the display portion 122 can be disposed at respective optimum positions at low cost. Thus, the latitude is provided for the disposition of the display portion 122 to meet the user's conveniences, so that user can easily observe the light emission, by which the user can be given predetermined information relative to the ink container 1. By employing an integral molding of the light guide portion 121 with the outer casing of the ink container 1, the manufacturing cost is not increased significantly by the provision of the light guide portion 121.

In this embodiment, an air layer (space) exists between the light guide portion 121 and the front side wall of the outer casing of the ink container forming the ink reservoir chamber 11. It would be considered that light guide portion is fully integral with the front side wall of the outer casing of the ink container, in other words, the front side wall of the outer casing of the ink container is utilized as the light guide portion. However, the structure of this embodiment is advantageous in that light guide to the display portion 122 is efficient. The description will be made as to this point.

In this embodiment, as shown in FIG. 2, (a) and (b), the light guide portion 121 is integrally connected with the outer casing of the ink reservoir chamber 11, but is independent of the front side wall. Namely, with the structure of this embodiment, there is provided an air layer between the light guide portion 121 and the ink reservoir chamber 11. The outer casing of the ink container is made of polypropylene material. If the light guide portion 121 is completely integral with the outer casing of the ink reservoir chamber 11, the material of the light guide portion 121 has to be polypropylene.

As shown in FIG. 2, (b), in this embodiment, the light emitted by the emitting portion 101 is incident on the light incident surface 123 which is an end surface of the light guide portion 121, and the light travels through the light guide portion 121 to the display portion 122 for display to the user. The emitting portion 101, as described hereinbefore, emits visible light, which is scattering light. Therefore, there are a plurality of light rays as shown by arrows A1-A3.

Here, it is assumed that light guide portion 121 has a refractive index of 1.49 (=n1) of polypropylene. Since the air has a refractive index of 1.00 (=n2), the critical refraction angle from the polypropylene to the air is determined by the following Snell law of refraction:

$$N1 \cdot \sin \Theta 1 = n2 \cdot \sin \Theta 2.$$

That is, the critical refraction angle is approx. 43°.

Therefore, the light rays which are incident at the incident angle Θ which is 43° or larger at the point (i) in (b) of FIG. 2, are totally reflected by the interface between the polypropylene (light guide portion 121) and the air, and the light rays travel in the light guide portion 121 while repeating total reflection as indicated by arrow A1 or A3 to the display portion 122. When the incident angle Θ1 is not more than 43°, the light ray transmits to the air and does not reach the display portion 122.

The predetermined information of the ink container (liquid container) 1 mentioned in the foregoing, includes the information as to whether or not the mounting state of the ink container 1 is proper (whether or not the mounting is complete), the information as to the properness of the mounting position of the ink container (whether or not the ink container is mounted at a correct position on the holder determined on the basis of the color of the ink contained therein). Furthermore, it includes the information concerning the ink remaining amount (whether or not the ink remaining amount is enough). Such types of information can be displayed by presence or absence of the light emission, state of light emission (flickering or the like), and so on.

1.2 Modified Examples (FIG. 4-FIG. 8)

The foregoing structures are examples and can be modified as long as the predetermined information relating to the ink container 1 can be given to the recording device and to the user by the first light emitting portion 101. The description will be made as to some modified examples.

Figure 4:
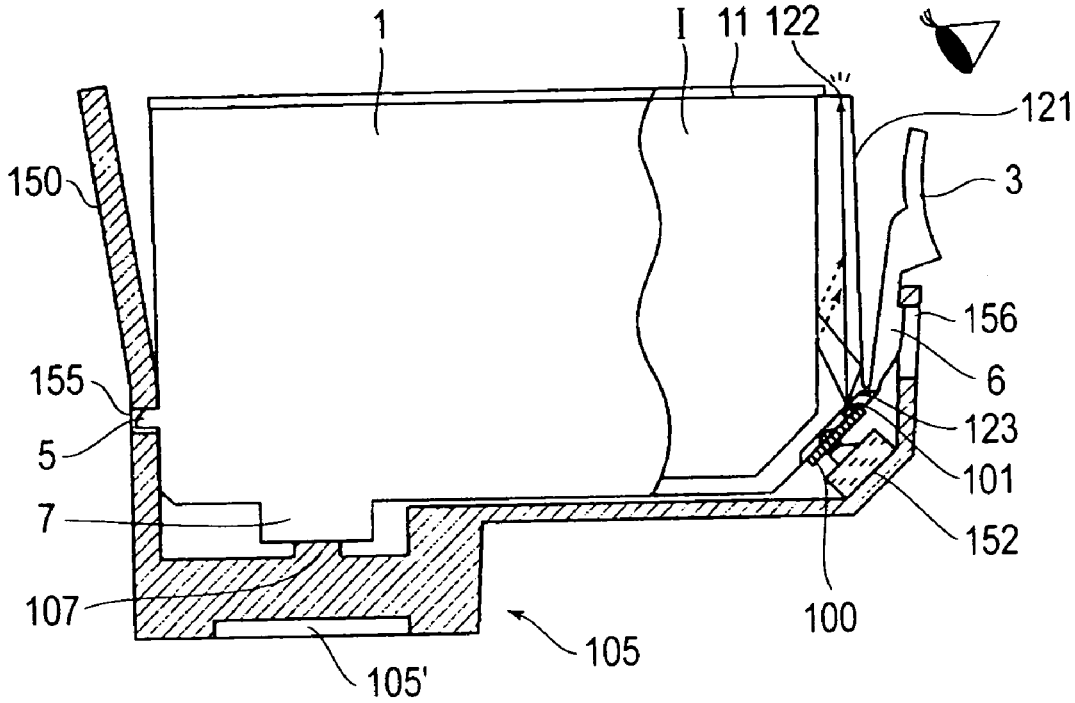
FIG. 4 is a schematic side view illustrating a modified example of the first embodiment.

FIG. 4 is a schematic side view illustrating a modified example of the first embodiment. In this embodiment, the light guide portion 121' is integral with the front side wall forming the ink reservoir chamber 11. In this modified embodiment, the light quantity reaching the display portion 122 is smaller than in the first embodiment wherein the space is provided between the light guide portion 121 and the ink reservoir chamber 11. This modified embodiment is preferable in that ink container is compact and in that ink accommodating efficiency is improved.

Figure 5:
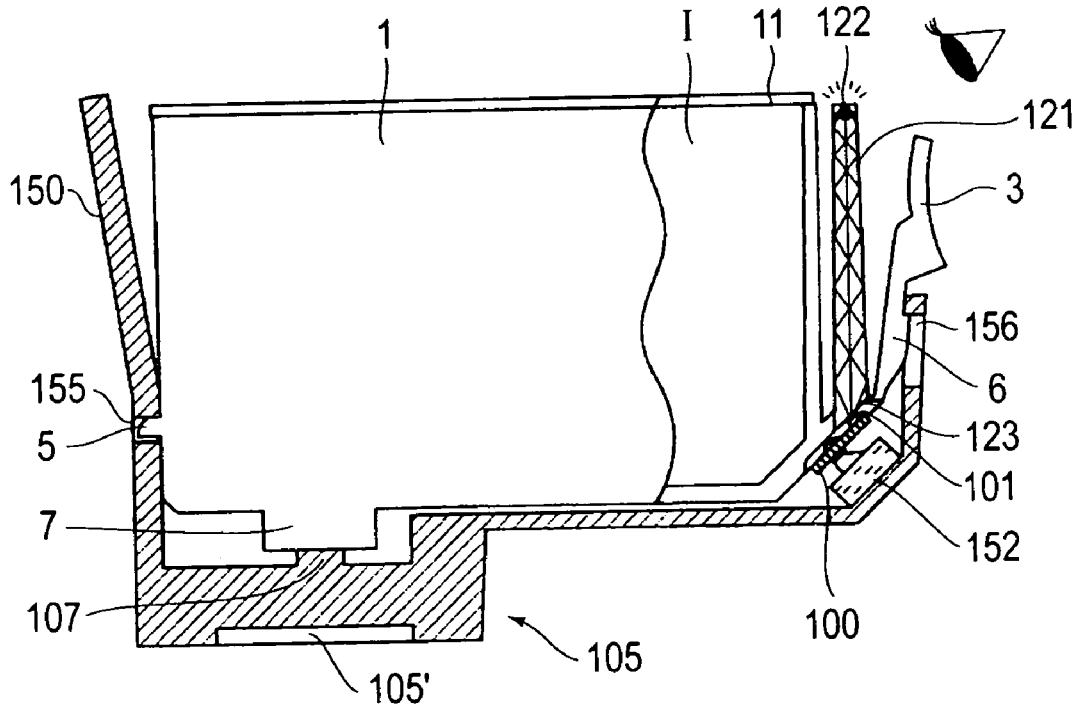
FIG. 5 is a schematic side view illustrating another modified example of the first embodiment.

FIG. 5 is a schematic side view illustrating another modified example of the first embodiment. In this example, the light guide portion 121 is formed by a member which is a separated member from the outer casing of the ink container 1, and then, they are unified. With such an example, proper materials can be selected, respectively. For example, the material of the light guide portion 121 may be polycarbonate material or acrylic material or the like which has refractive indices which are more greatly different from that of the air so that light emitted from the emitting portion can be efficiently guided. On the other hand, as for the material of the outer casing of the ink container 1, polypropylene material having a high suppression effect against evaporation of the ink I in the ink container can be selected. Since they can be produced from different materials, the material of the ink container 1 which is not necessarily transparent can be selected from wider choice.

Figure 6:
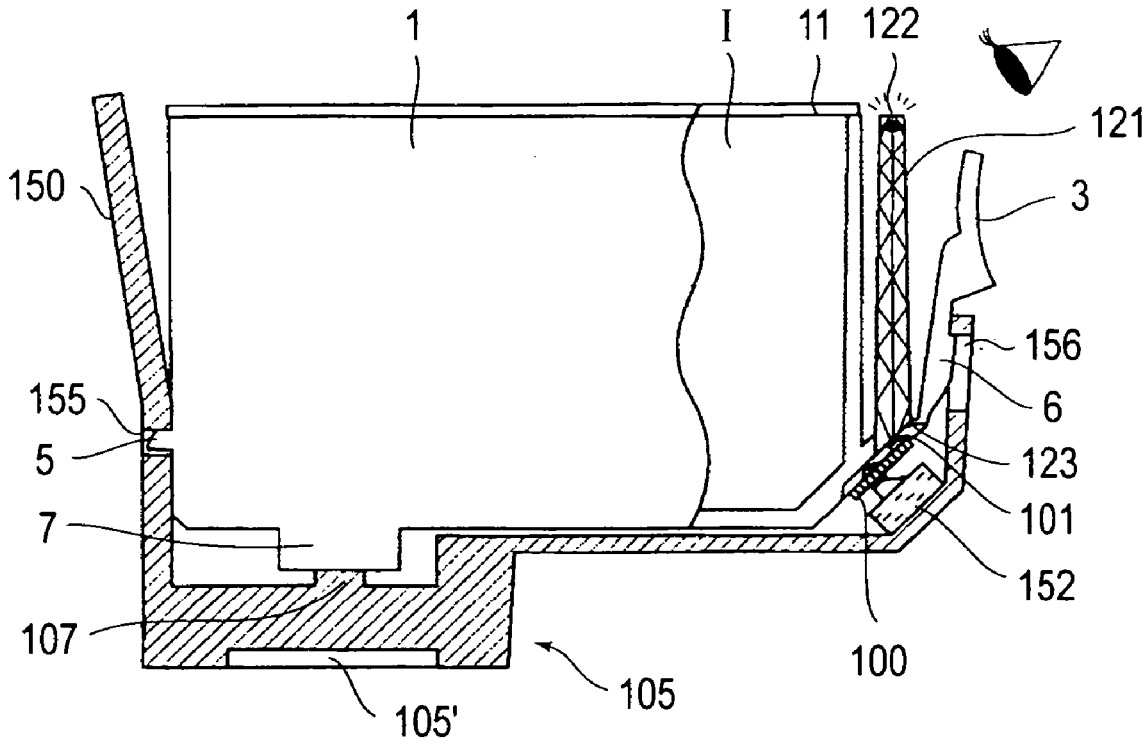
FIG. 6 is a schematic side view illustrating another modified example of the first embodiment.

FIG. 6 is a schematic side view illustrating a further modified example of the first embodiment. In this example, the display portion 122 at the free end of the light guide portion 121 has a substantially semi-spherical configuration, and the light is preferably scattered by surface roughening. With this example, the light ray guided by the light guide portion 121 is scattered by the display portion, and therefore, the light quantity attenuates, but the light can be presented in a wider angle from the display portion. By doing so, the visual angle (range) increases, thus further improving the visualization.

Figure 7:
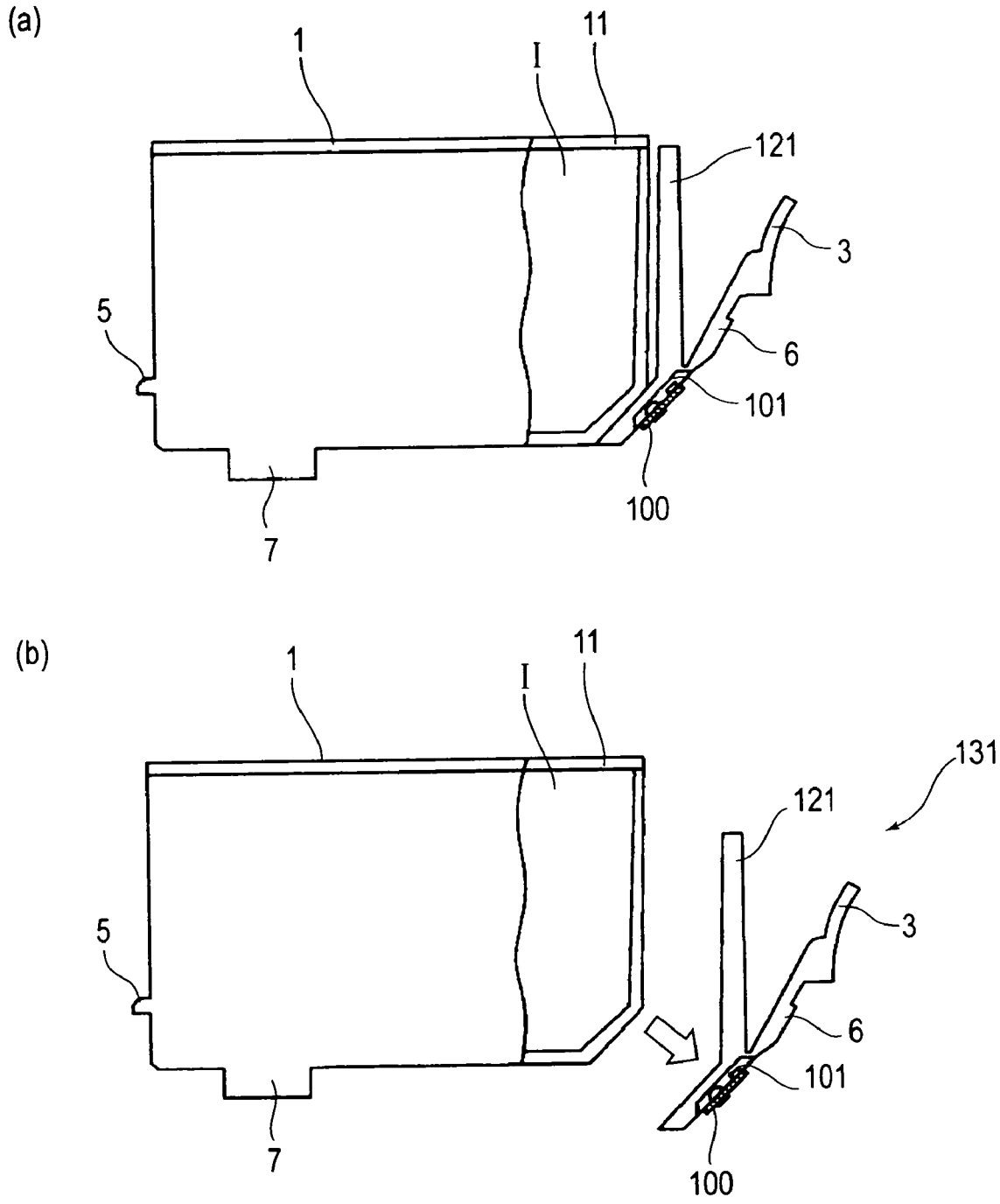
FIG. 7 is a schematic side view illustrating another modified example of the first embodiment.

FIG. 7 is schematic side views ((a) and (b)) illustrating a further modified example of the first embodiment. In this example, the light guide portion 121, the supporting member 3 and a portion on which the substrate 100 is adhered are made of an integral member 131, which is a separate member from the member constituting the outer casing of the ink container 1. By doing so, similarly to the example of FIG. 5, suitable materials can be selected to meet the requirements of member constituting the outer casing of the ink container and the member constituting the light guide portion, respectively. As shown in FIG. 7, (b), the member 131 to which the substrate 100 is adhered is separable, so that after the ink I in the ink container 1 is all used up, the member 131 may be mounted to a new ink container, that is, it is reusable. This reduces the running cost since the substrate 100 and/or the emitting portion 101 which are relatively expensive parts, can be reused.

Figure 8:
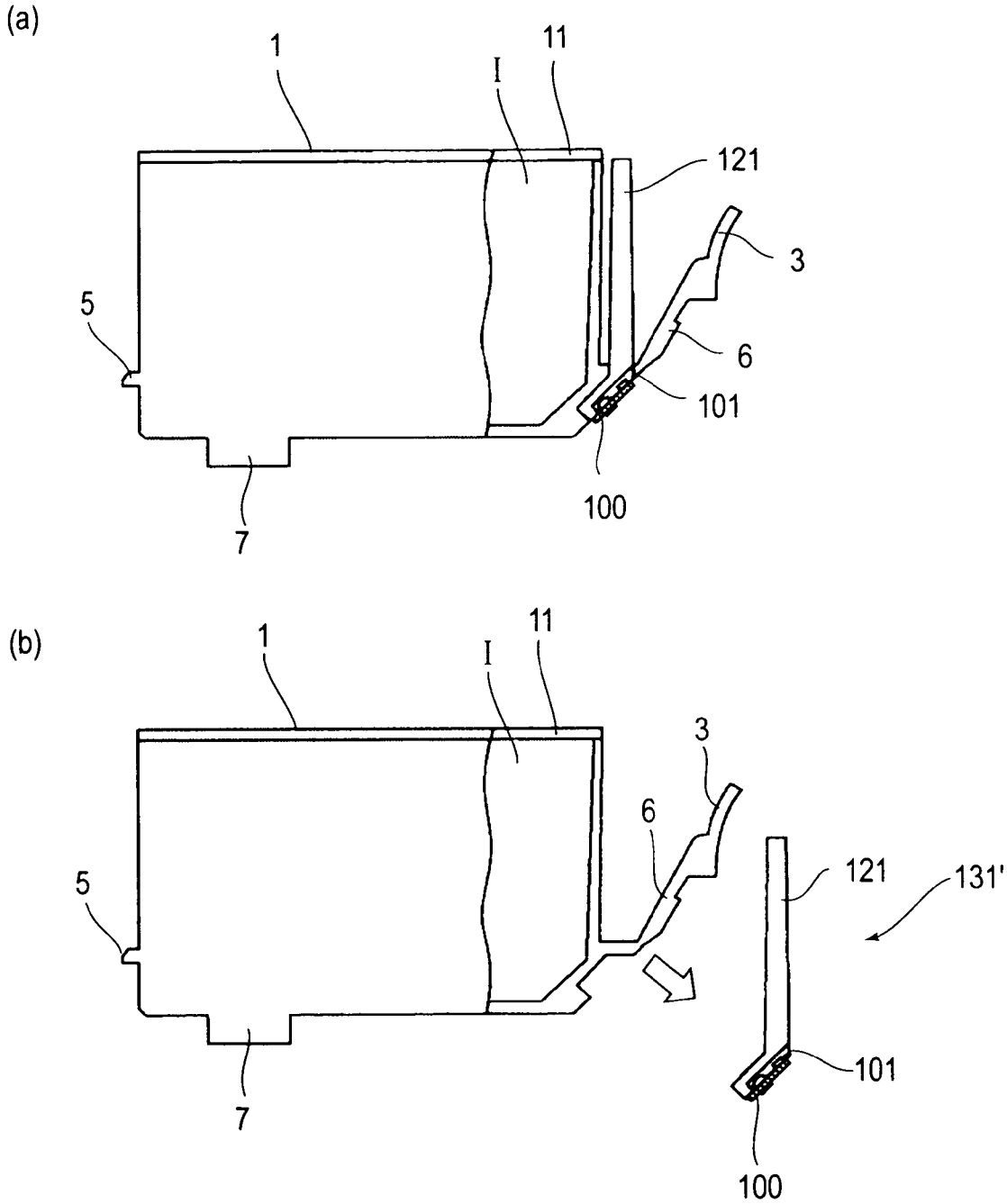
FIG. 8 is a schematic side view illustrating another modified example of the first embodiment.

FIG. 8 is schematic side views ((a) and (b)) illustrating a further modified example of the first embodiment. In this example, the light guide portion 121 and the portion to which the substrate 100 is adhered are made of an integral member 131', and the member 131' constitutes the outer casing of the ink container 1 and is separate from the member constituting the supporting member 3. With this structure, similarly to the example of FIG. 5, the choice of the material is increased. In FIG. 8, (b), the member 131' which integrally has the light guide portion 121 and the portion to which the substrate 100 is adhered is separable, and therefore, they can be reused.

In the first embodiment and the modified example, the air layer is provided between the ink reservoir chamber 11 and the light guide portion 121, so that attenuation of the light incident on the emitting portion 101 is suppressed to accomplish improved visualization. However, this can be accomplished by interposing another member between the ink reservoir chamber 11 and the light guide portion 121.

Figure 9:
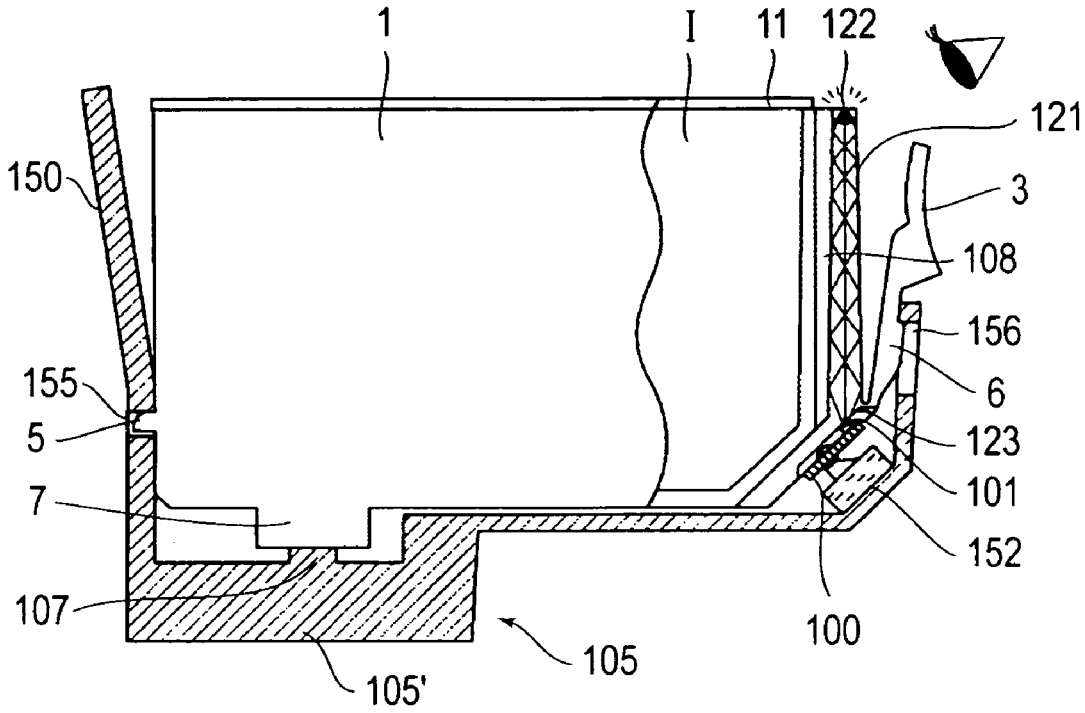
FIG. 9 is a schematic side view illustrating another modified example of the first embodiment.

FIG. 9 is a schematic side view illustrating a further modified example of the first embodiment. In this example, a low refractive index member 108 having a refractive index which is smaller than that of the light guide portion 121 is interposed between the light guide portion 121 and the front side wall surface of the ink reservoir chamber 11 accommodating the ink I. The light guide portion 121 of this example is a separated member from the ink container 1 and is made of polycarbonate exhibiting high light transmissivity. The low refractive index member 108 is made of polytetrafluoroethylene material.

Here, the refractive index of the polycarbonate is 1.59, and the refractive index of the polytetrafluoroethylene is 1.35. From the Snell law of refraction, the critical refraction angle from the polycarbonate to the polytetrafluoroethylene is approx. 58°, and therefore, the light rays having the incident angles ranging from 58° to 90° among the light rays emitted from the emitting portion 101 reaches the display portion 122.

In this example, the low refractive index member 108 may be replaced with a reflection member made of metal. In the foregoing examples, wherein the use is made with the difference in the refractive index between the materials, the light rays not satisfying the condition of total reflection are transmitted, with the result that total light quantity attenuates more or less. By providing a reflection member, the light rays incident on the incident surface 123 and reaching the reflection member can be substantially completely reflected. By this, the light can be guided efficiently, and the visualization is improved.

Figure 10:
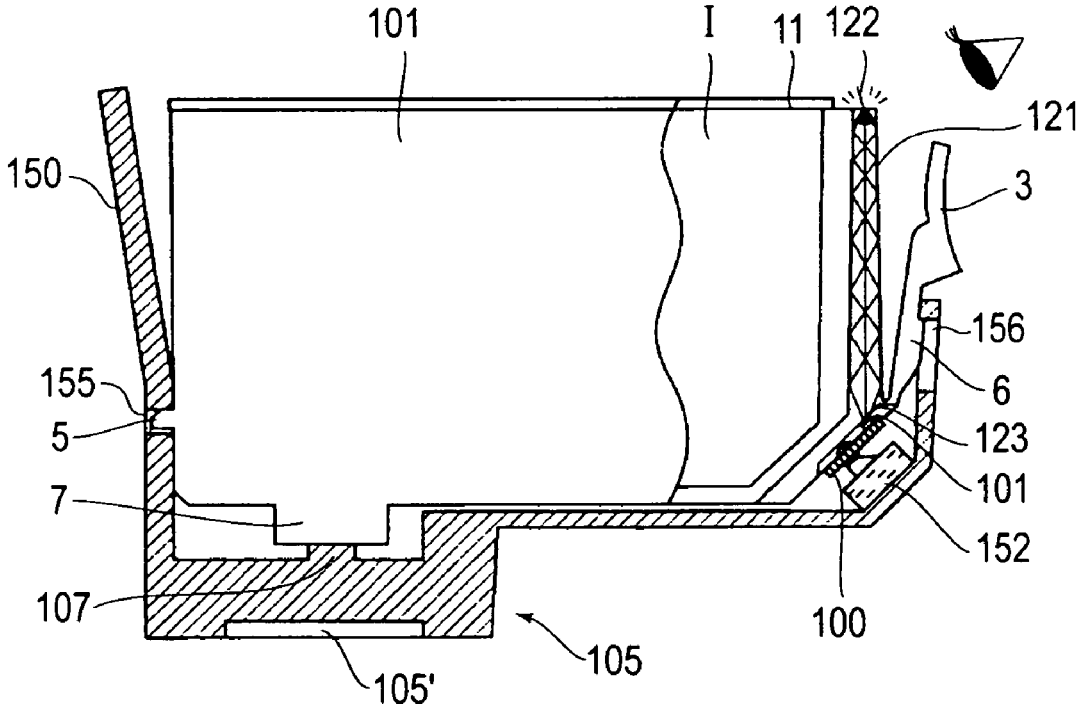
FIG. 10 is a schematic side view illustrating another modified example of the first embodiment.

FIG. 10 is a schematic side view illustrating a further modified example of the first embodiment. However, in this example, the ink reservoir chamber 11 is made of polytetrafluoroethylene material similarly to the low refractive index member 108, and the light guide portion 121 is made of polycarbonate. For this reason, similarly to the example of FIG. 9, the light emitted from the emitting portion 101 can be guided to the display portion 122 with high efficiency.

With such modified examples, the emitting portion and the display portion are separated, and the light guide portion 121 for optical connection between them is provided on the ink container 101, so that emitting portion 142 and the display portion 122 can be placed at respective optimum positions, at low cost and without necessity of wiring for the electric power supply and signal exchange which might deteriorate the operationality and observation. By doing so, thus, the latitude is provided for the disposition of the display portion 122 to meet the user's conveniences, so that user can easily observe the light emission, by which the user can be assuredly given predetermined information relative to the ink container 1.

The modified example of the first embodiment is not limited to those described above. The examples can be further modified within the spirit of the present invention by one skilled in the art. For example, in the foregoing examples, the light guide portion is made of resin material, and the difference in the refractive index between the material and the air contacted thereto is used to guide the light. But, an optical fiber comprising a core and a cladding is usable. In place of the solid light guide portion, a hollow member having an inner reflecting surface (stainless steel pipe) is usable.

Two or more of the foregoing examples may be combined. The surface treatment of the display portion 122 described in conjunction with FIG. 6 may b e used in the first embodiment or modified examples thereof.

This applies to the second embodiment, the third embodiment and the modified examples thereof which will be described hereinafter.

Figure 11:
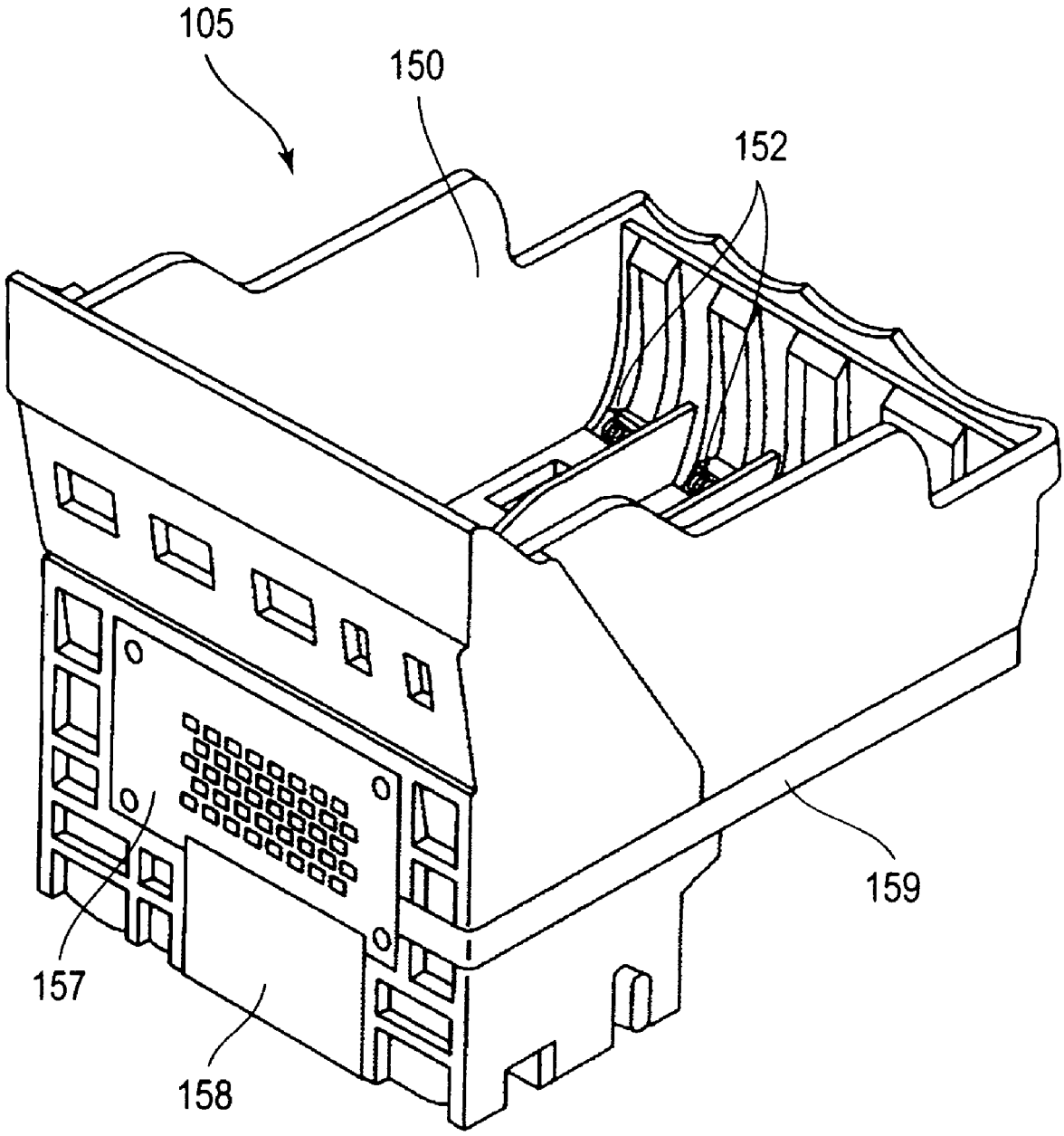
FIG. 11 is a perspective view of an example of a recording head unit to which the ink container according to the first embodiment is detachably mountable.
Figure 12:
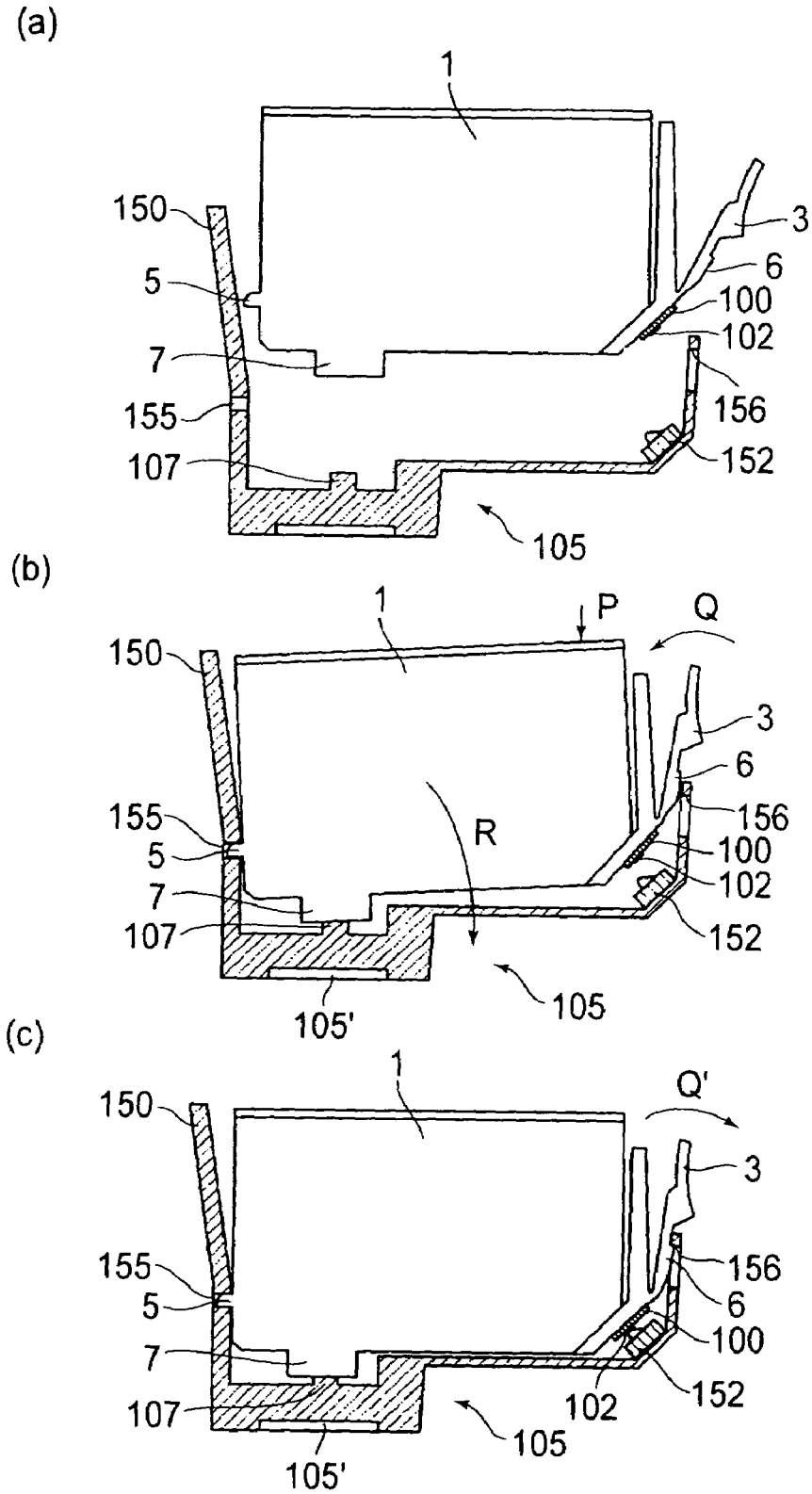
FIG. 12 illustrates mounting operations (a)-(c) of the ink container to the recording head unit.
Figure 13:
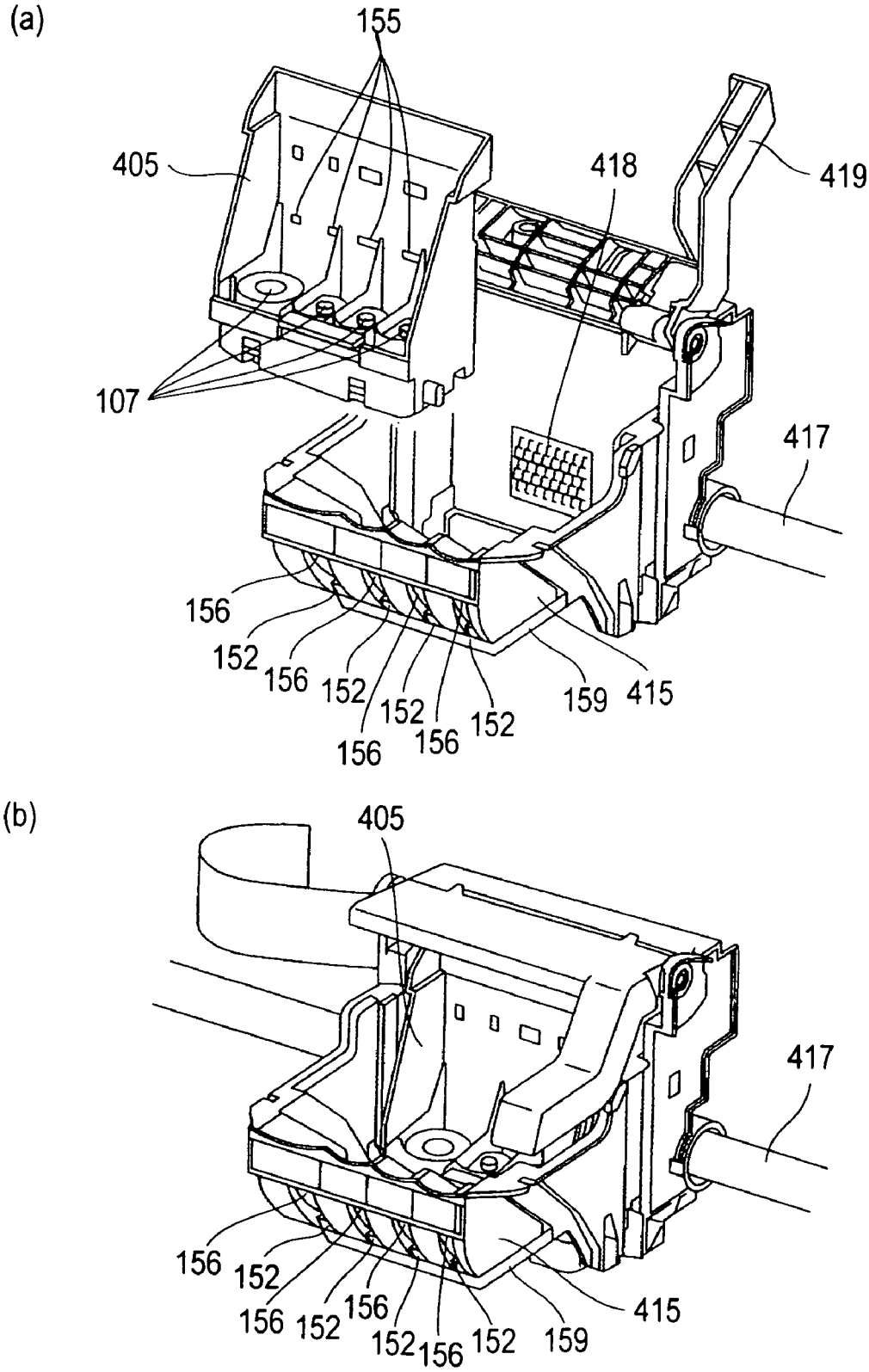
FIG. 13 is a perspective view (a) of a recording head unit for receiving ink from the ink container to effect a recording operation according to another example, and a perspective view of a carriage usable therewith, and a perspective view (b) showing a state in which they are connected with each other.

1.3 Ink Container Mounting Portion (FIG. 11-FIG. 13)

FIG. 11 is a perspective view illustrating an example of a recording head unit having a holder to which the ink container according to the first embodiment is mountable. FIG. 12, ((a)-(c)) is a schematic side view illustrating an operation of mounting and demounting of the ink container according to the first embodiment. The mounting portion described here is applicable to the embodiments which will be described below and modified examples thereof.

The recording head unit 105 is generally constituted by a holder 150 for detachably holding a plurality (four, in the example shown in the Figure) of ink containers, and a recording head 105 disposed adjacent the bottom side (unshown in FIG. 11). By mounting the ink container to the holder 150, an ink introduction opening 107 of the recording head disposed adjacent the bottom portion of the holder is connected with the ink supply port 7 of the ink container to establish an ink fluid communication path therebetween.

An example of usable recording head 105' comprises a liquid passage constituting a nozzle, an electrothermal transducer element provided in the liquid passage. The electrothermal transducer element is supplied with electrical pulses in accordance with recording signals, by which thermal energy is applied to the ink in the liquid passage. This causes a phase change of the ink resulting in bubble generation (boiling), and therefore, abrupt pressure rise, by which the ink is ejected from the nozzle. An electrical contact portion (unshown) for signal transmission provided on the carriage 203 which will be described hereinafter, and an electrical contact portion 157 of the recording head unit 105, are electrically contacted to each other, so that transmission of the recording signal is enabled to the electrothermal transducer element driving circuit of the recording head 105' through the wiring portion 158. From the electrical contact portion 157, a wiring portion 159 is extended to the connector 152.

When the ink container 1 is mounted to the recording head unit 105, the holder 150 is brought to above the holder 150 ((a) in FIG. 12). A first engaging portion 5 in the form of a projection provided on an ink container rear side is inserted into a first locking portion 155 in the form of a through hole provided in a holder rear side, so that ink container 1 is placed on the inner bottom surface of the holder ((b) of FIG. 12). With this state kept, the front side upper end of the ink container 1 is pressed down as indicated by arrow P, by which the ink container 1 rotates in the direction indicated by the arrow R about the engaging portion between the first engaging portion 5 and the first locking portion 155, so that front side of the ink container displaces downwardly. In the process of this action, the supporting member 3 is displaced in the direction of an arrow Q, while a side surface of a second engaging portion 6 provided in the supporting member 3 on the ink container front side is being pressed to the second locking portion 156 provided on the holder front side.

When the upper surface of the second engaging portion 6 reaches a lower portion of the second locking portion 156, the supporting member 3 displaces in the direction Q' by the elastic force of the supporting member 3, so that second engaging portion 6 is locked with the second locking portion 156. With this state ((c) in FIG. 12), the second locking portion 156 elastically urges the ink container 1 in a horizontal direction through the supporting member 3, so that rear side of the ink container 1 is abutted to the rear side of the holder 150. The upward displacement of the ink container 1 is suppressed by the first locking portion 155 engaged with the first engaging portion 5 and by the second locking portion 156 engaged with the second engaging portion 6. At this time, the mounting of the ink container 1 is completed, wherein the ink supply port 7 is connected with the ink introduction opening 107, and the pad 102 is electrically connected with the connector 152.

The above-described uses the principle of "lever" during the mounting process shown in (b) of FIG. 12, wherein the engaging portion between the first engaging portion 5 and the first locking portion 155 is a fulcrum, and the front side of the ink container 1 is a power point where the force is applied. The connecting portion between the ink supply port 7 and the ink introduction opening 107 is a working point which is located between the power point and the fulcrum, preferably, closer to the fulcrum. Therefore, the ink supply port 7 is pressed against the ink introduction opening 107 with a large force by the rotation of the ink container 1. At the connecting portion, an elastic member such as a filter, an absorbing material, a packing or the like which has a relatively high flexibility is provided to assure an ink communication property to prevent ink leakage there.

Such structure, arrangement and mounting operation are therefore preferable in that such a member is elastically deformed by the relatively large force. When the mounting operation is completed, the first locking portion 155 engaged with the first engaging portion 5 and the second locking portion 156 engaged with the second engaging portion 6 are effective to prevent the ink container 1 from rising away from the holder. Therefore, the restoration of the elastic member is suppressed, so that member is kept in an appropriately deformed elastically.

On the other hand, the pad 102 and the connector 152 (electrical contacts) are made of a relatively rigidity electroconductive material such as metal to assuring satisfy electrical connection property therebetween. However, an excessive contact force therebetween is not preferable from the standpoint of damage prevention and sufficient durability. In this example, they are disposed at a position as remote as possible from the fulcrum, more particularly, in the neighborhood of the front side of the ink container, in this example, by which the contact force is minimized.

In this example of the embodiment, the substrate 100 is disposed on the inclined surface connecting the bottom side of the ink container 1 with the front side of the ink container 1, namely, at the corner portion therebetween. The balance of forces only at the contact portion in the state that pad 102 is contacted to the connector 152 immediately before the completion of mounting, will be considered. The reaction force (a upward force in the vertical direction) applied by the connector 152 to the pad 102 and balancing with the mounting force applied downwardly in the vertical direction, involves a component force of the actual contact pressure between the pad 102 and the connector 152. Therefore, when the user presses the ink container down toward the mounting completion position, an addition of ink container mounting force for electrical connection between the substrate and the connector is small, so that operativity will not be much deteriorated.

The ink container 1 is pressed down toward the mounting completion position where the first engaging portion 5 and the first locking portion 155 are engaged with each other, and the second engaging portion 6 and the second locking portion 156 are engaged with each other. By this, there arises a component force (a force sliding the pad 102 on the connector 152) parallel with a surface of the substrate 100 by the urging force. Therefore, a good electrical connection property is provided and assured upon the completion of the mounting of the ink container. In addition, the electrical connecting portion is at a position high from the bottom side of the ink container, and therefore, the liability of the leaked ink reaching there is small.

In this manner, the structure and arrangement of the electrical connecting portion described above is advantageous from the standpoint of the magnitude of the required ink container mounting force, assurance of the electrical contact state and the protection from contamination with the leaked ink.

The structure of the mounting portion for the ink container in the first embodiment or the modified example is not limited to that shown in FIG. 11.

Referring to FIG. 13, the description will be made as to this point. FIG. 13 is a perspective view (a) of a recording head unit for receiving ink from the ink container to effect a recording operation according to another example, and a perspective view of a carriage usable therewith, and a perspective view (b) showing a state in which they are connected with each other.

As shown by (a) in FIG. 13, the recording head unit 405 of this example is different from those (holder 150) described hereinbefore in that it does not have the holder portion corresponding to the ink container front side, the second locking portion or the connector. The recording head unit 405 is similar to the foregoing one in the other respects, the bottom side thereof is provided with an ink introduction opening 107 to be connected with the ink supply port 7. The rear side thereof is provided with the first locking portion 155, and the back side is provided with an electrical contact portion (unshown) for signal transmission.

On the other hand, as shown by (b) in FIG. 13, the carriage 415 is movable along a shaft 417, and is provided with a lever 419 for fixing the recording head unit 405. The carriage 415 is further provided with an electrical contact portion 418 connected with the electrical contact portion of the recording head and with a holder portion corresponding to the structure of the ink container front side. The second locking portion 156, the connector 152 and the wiring portion 159 to the connector, are provided on the carriage side.

With this structure, when the recording head unit 405 is mounted on the carriage 415, as shown by (b) in FIG. 13, the mounting portion for the ink container is established. In this manner, through the mounting operation which is similar to the example of FIG. 12, the connection between the ink supply port 7 and the ink introduction opening 107, and the connection between the pad 102 and the connector 152, are established, and the mounting operation is completed.

Figure 14:
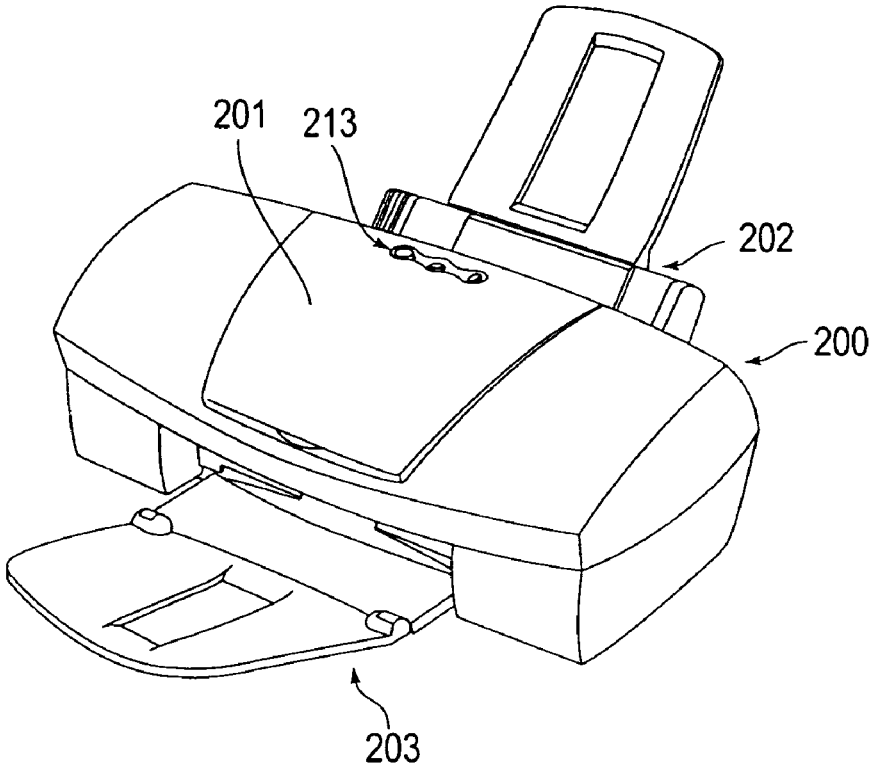
FIG. 14 is a perspective view of an outer appearance of an ink jet printer usable with the ink container.
Figure 15:
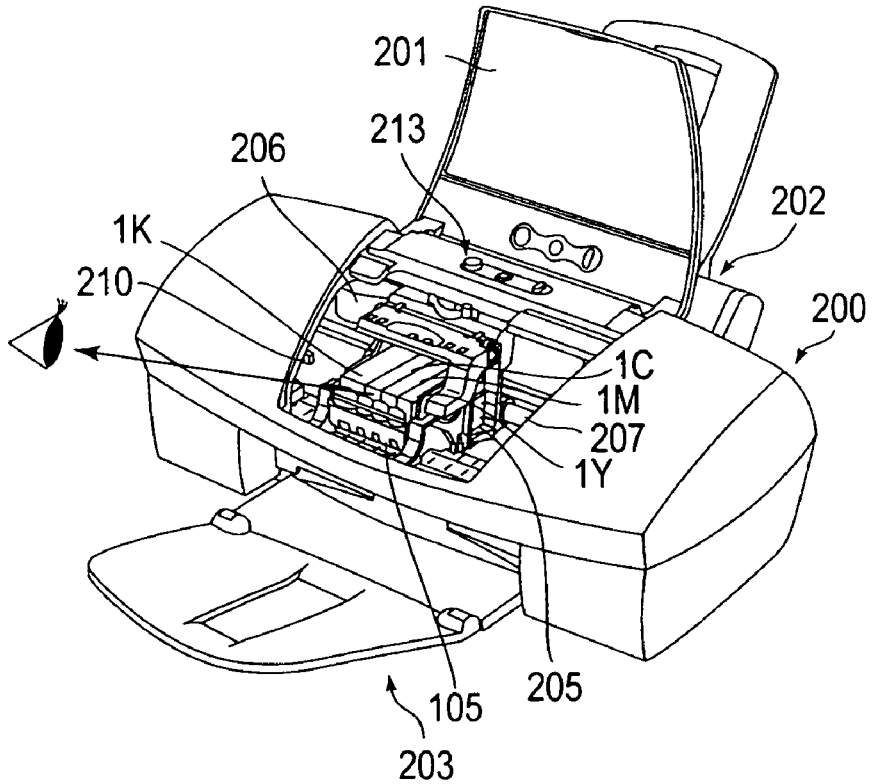
FIG. 15 is a perspective view of the recording device of FIG. 14 with the main assembly cover omitted.

1.4 Recording Device (FIG. 14-FIG. 15)

FIG. 14 shows an outer appearance of an ink jet printer 200 to which the ink container described in the foregoing. FIG. 15 is a perspective view of the printer in which the main assembly cover 201 of FIG. 14 is open. The recording device is applicable to the embodiments and modified examples which will be described below.

As shown in FIG. 14, the printer 200 of this embodiment comprises a main assembly, a sheet discharge tray 203 at the front side of the main assembly, an automatic sheet feeding device (ASF) 202 at the rear side thereof, a main assembly cover 201, and other case portions which cover major parts including a mechanism for scanningly moving the carriage carrying the recording heads and the ink containers and for effecting the recording during the movement of the carriage. There is also provided an operating panel portion 213 which includes a displaying device which in turn displays states of the printer irrespective of whether the main assembly cover is closed or opened, a main switch, and a reset switch.

When the main assembly cover 201 is open, the user can see them, as shown in FIG. 15. That is, when the main assembly cover 201 is open, the user can see the movable range, the neighborhood thereof which carries the recording head unit 105 and the ink containers 1K, 1Y, 1M and 1C (the ink containers may be indicated by reference numeral "1" only hereinafter for simplicity). In this embodiment, when the main assembly cover 201 is opened, a sequence operation is carried out so that carriage 205 is automatically comes to the center position ("container exchanging position", shown in the Figure), where the user can do the ink container exchanging operation or the like.

In this embodiment, the recording head (unshown) is in the form of a chip mounted to the recording head unit 105, corresponding to the respective inks. The recording heads scan the recording material by the movement of the carriage 205, during which the recording heads eject the ink to effect the printing. The carriage 205 is capable of slidable engagement with the guiding shaft 207 extending in the moving direction of the carriage 205, and is movable as described above by the carriage motor and the transmission movement mechanism thereof. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 having an integral ink container holder is detachably mounted on the carriage 205, and the respective ink containers 1 are detachably mounted on the recording head unit 105.

During the recording or printing operation, the recording head scan the recording material by the above-described movement, during which the recording heads eject the inks onto the recording material to effect the recording on a width of the recording material corresponding to the range of the array of ejection outlets of the recording head. In a time period between a scanning operation and the next scanning operation, the paper feeding mechanism feeds the recording material through a predetermined distance corresponding to the width. In this manner, the recording is sequentially effected to cover the entire area of the recording material. An end portion of the movement range of the recording head by the movement of the carriage, there is provided an ejection refreshing unit including caps for capping the sides of the recording heads having the ejection outlets. Therefore, the recording heads move to the position of the refreshing unit at predetermined time intervals, and are subjected to the refreshing process including the preliminary ejections or the like.

The recording head unit 105 having a holder portion for each ink container 1, is provided with a connector corresponding to each of the ink containers, and the respective connectors are contacted to the pad of the substrate provided on the ink container 1. By doing so, turning-on and flickering of the respective emitting portions 101 can be controlled in accordance with the predetermined sequence executed by the recording device. Thus, the information relating to the state of the ink container can be notified.

More specifically, after the position of the container exchange, the emitting portion 101 of the ink container 1 containing small amount of the ink is turned on or flickered, and the event can be observed by the user through the light guide portion 121 and the display portion 122. This applies to the respective ink containers 1. In another example of control of the switching of the emitting portion, when the ink container 1 is mounted to the correct position, the emitting portion 101 of the container is lighted on, by which the user can observe the event through the light guide portion 121 and the display portion 122. These controls are executed, similarly to the control for the ink ejection of the recording head, by supplying control data (control signal) to the respective ink containers form the main assembly side control circuit through the flexible cable 206.

The light receiving portion 210 having the light receiving element can be disposed adjacent the end portion which is opposite the position where the above-described refreshing unit is provided. By doing so, the emitting portion 101 is actuated when the display portion 122 of the ink container 1 passes by the light receiving portion while the carriage 205 is moving, and the emitted light can be received by the light receiving portion through the light guide portion 121 and the display portion 122. On the basis of the provision of the carriage 205 when the light is received, it can be discriminated as to whether or not an ink container 1 is mounted and/or whether or not the ink container 1 is mounted at the correct position on the carriage 205. Thus, the display portion 122 not only functions to present the information to the user but also functions to contribute to the detecting operation and the control operation of the recording device. A further preferable Embodiment to accomplish both of them will be described hereinafter in conjunction with a third Embodiment.

2. Second Embodiment (FIG. 16-FIG. 20)

In the foregoing Embodiments and classification is, the light guide portion 121 is extended upwardly from the neighborhood of the emitting portion 101 to the display portion 122 which is located at the top end. The description will be made as to examples in which the display portion is located at a position which is more convenient to the user. The same reference numerals as with the foregoing embodiment are assigned to the elements having the corresponding functions, and the detailed descriptions for such elements are omitted for simplicity.

Figure 16:
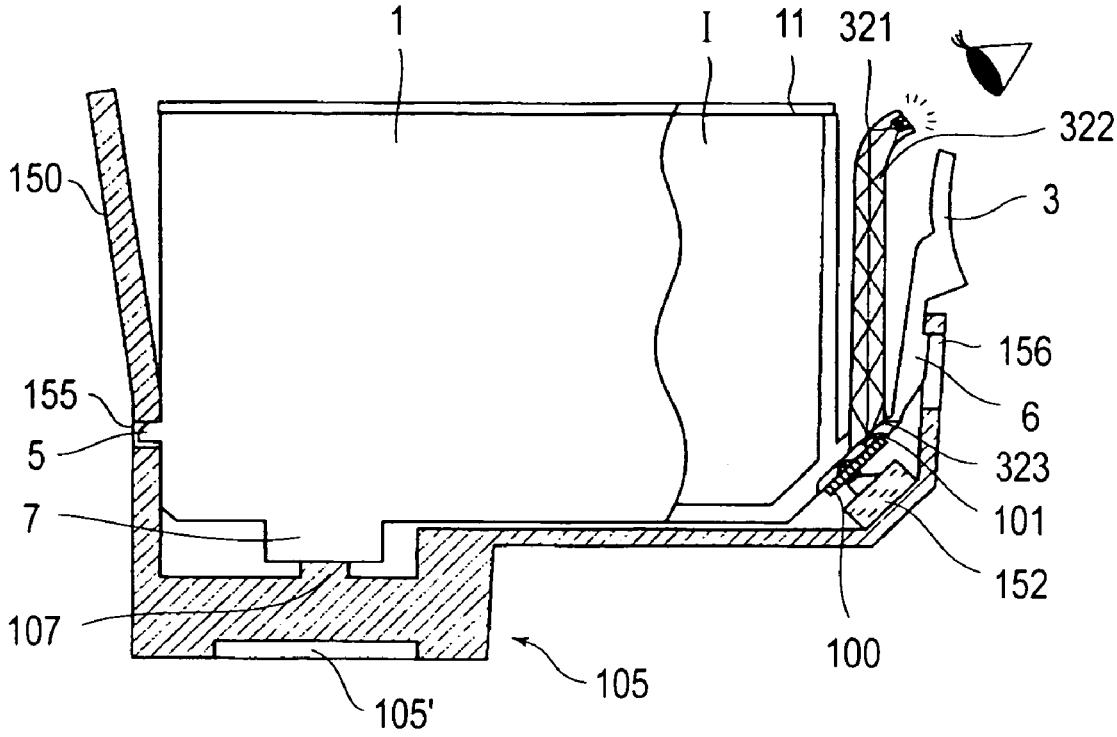
FIG. 16 is a schematic side view illustrating function of the light guide portion provided on the ink container according to the second embodiment of the present invention.

FIG. 16 is a schematic side view illustrating function of the light guide portion provided on the ink container according to the second embodiment of the present invention. In this embodiment, the light is guided from the emitting portion 101 to the display portion 322, and a light guide portion 321 for observation of the user is extended upwardly with an air space provided between the light guide portion 321 and the front side wall surface of the ink reservoir chamber 11 for containing the ink I, and the free end portion is curved so that display portion 322 is directed in an upper-right direction.

With this structure, similarly to the first Embodiment, the light can be extended to the display portion 322 while suppressing the attenuation all the light incident from the emitting portion 101. Moreover, the light guide portion 321 is curved so as to direct the display portion 322 toward upper right in the Figure, the display portion 322 can be easily observed by the user.

Figure 17:
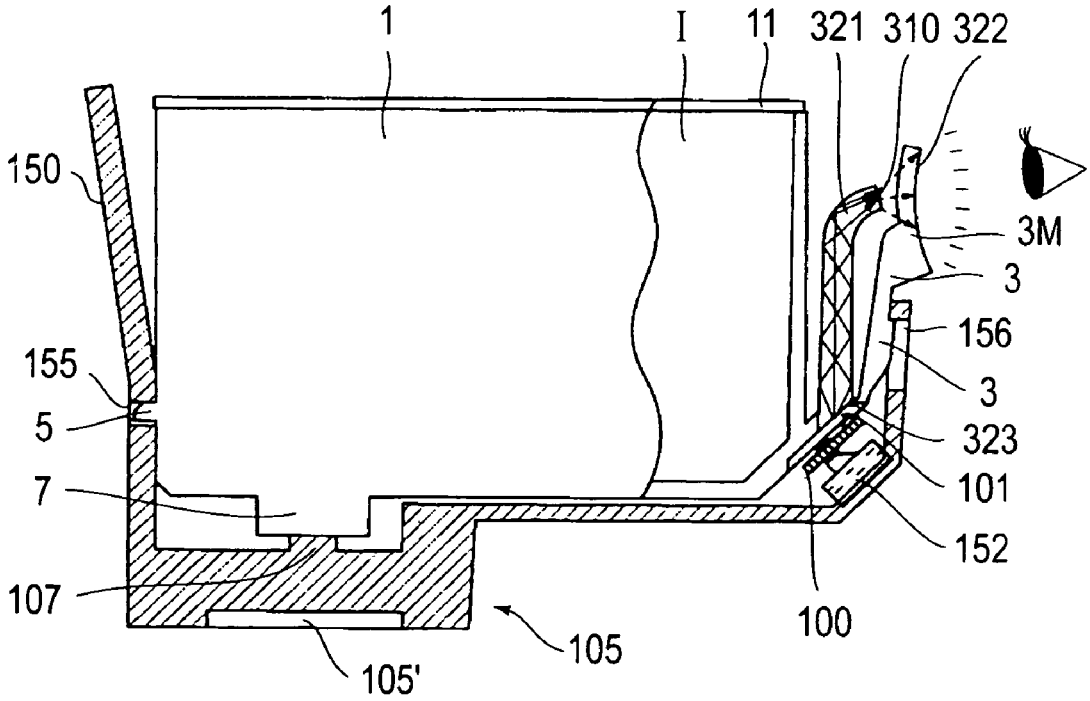
FIG. 17 is a schematic side view of a modified example of FIG. 16.

FIG. 17 is a schematic side view of a modified example of the structure of FIG. 16. In this embodiment, too, the light guide portion 321 is curved, but the high is lower than in FIG. 16, such that end surface 310 is opposed to the back side of the supporting member 3, more particularly, of the operating portion 3M which is the portion to be manipulated by the user. At least the operating portion 3M of the supporting member 3 in this embodiment is constituted by a light transmitting member in this example.

As shown in FIG. 17, in this example, the light emitted from the emitting portion 101 is guided to the end surface 310 by the light guide portion 321, and then the light is directed to the operating portion 3M. By doing so, the operating portion 3M of the supporting member 3 constituted by the light transmitting member is lighted up. In other words, the operating portion 3M per se functions as the display portion for providing user with the information.

This example provides the same advantageous effects as with the first Embodiment. In addition, according to these features example, the operating portion 3M which is to be manipulated by the user is lighted up. Therefore, when the user is to be prompted for exchange of the ink container, the object ink container can be to directly recognized, and the portion to be manipulated for the mounting or dismounting of the ink containers can be directly recognized, too. In the order to make the light more visible at the operating portion 3M, the operating portion 3M may be provided with a portion for scattering a proper amount of light.

The structure of bending the optical axis in order to locate the display portion is not limited to curving the light guide portion. The description will be made as to this point.

Figure 18:
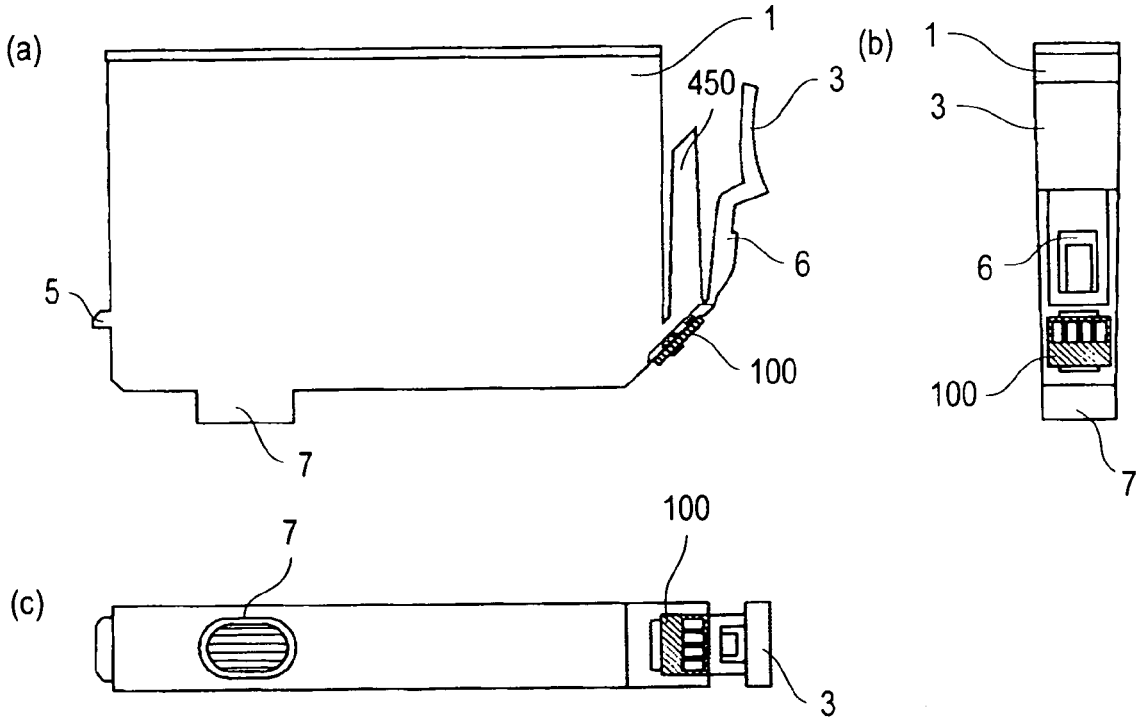
FIG. 18 a side view (a), a front view (b) and a bottom view (c) of an ink container which is a liquid container according to another example of the second embodiment.

FIG. 18 a side view (a), a front view (b) and a bottom view (c) of an ink container which is a liquid container according to another example of the second embodiment. The position from which the light guide portion 450 extends upwardly is substantially the same as with the foregoing examples, but the light guide portion 450 of this example is not curved but is substantially extended straight. An inclined surface 451 is provided at the top end portion. The position of the inclined surface 451 is at the back side of the operating portion 3M of the supporting member 3, and the portion opposed to the back side of the operating portion 3M is high, and the portion opposed to the front side of the ink reservoir chamber 11 is low. Between the light guide portion 450 and the surface of the front side wall of the ink container 1, there is air space. When the light guide portion 450 is integrally molded with the outer casing of the ink container 1, the whole member is constituted by a light transmitting material.

Figure 19:
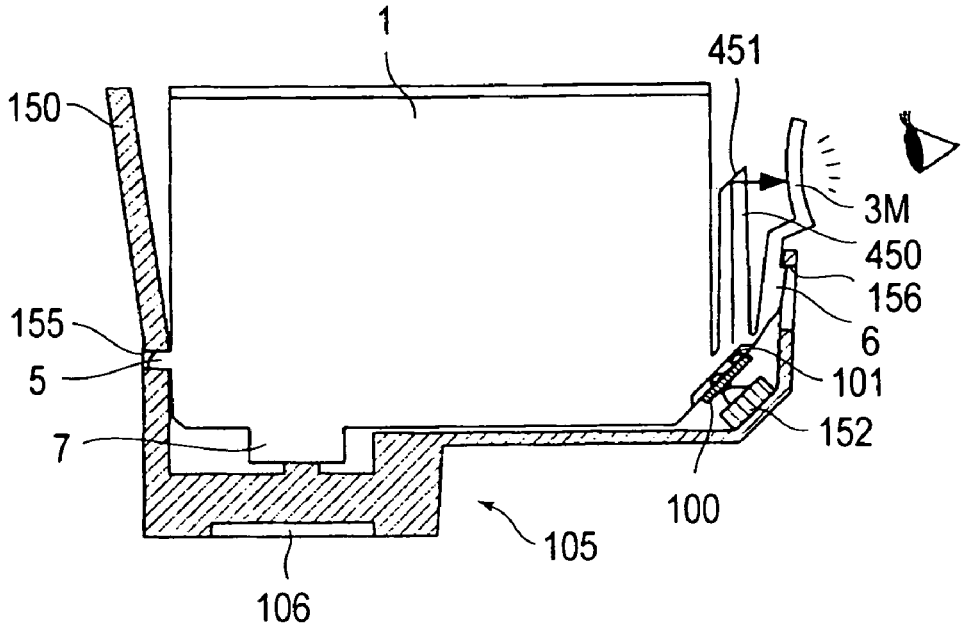
FIG. 19 is a schematic side view (a) and an enlarged view (b) of a major part of the light guide portion to illustrate the function of the light guide portion.
Figure 19:
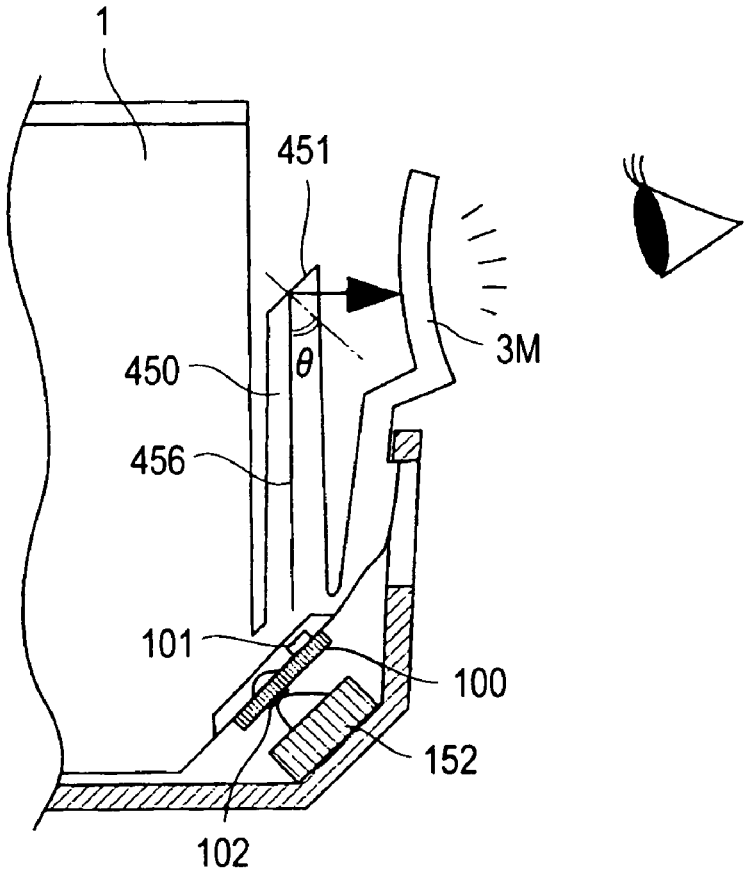

The description will be made as to the structure and the function off the light guide portion 450 of this example. FIG. 19 is a schematic side view (a) and an enlarged view (b) of a major part of the light guide portion to illustrate the function of the light guide portion.

As shown in these Figures, the light guide portion 450 each extended up from the position where the bottom side end surface is opposed to the emitting portion 101. Therefore, when the emitting portion 101 emits the light, the light is guided from the end surface of the bottom side of the light guide portion 450 to the inclined surface 451 at the top end portion, and is reflected by an inclined surface 451 to reach an operating portion 3M. Similarly to the example of FIG. 17, the structure of this example is such that light from the emitting portion 101 disposed at the bottom side of the ink container 1 is guided to the operating portion 3M through the light guide portion 450, and therefore, the user manipulating the operating portion 3M naturally recognizes the predetermined information relating to the ink container 1.

The preferable positional relation among the light guide portion 450, the inclined surface 451 and the emitting portion 101 are as follows. It is preferable from the standpoint of supplying a large amount of light that in order for the light emitted by the emitting portion 101 to be guided to the inclined surface 451 by the light guide portion 450, the emitting portion 101 is opposed to the end surface of the bottom side of the light guide portion 450 and on the projected plane of a cross-section of the light guide portion 450 (perpendicular to the optical axis 456 of the light guide portion 450).

In order for the light reflected by the inclined surface 451 to smoothly reach the operating portion 3M, it is preferable that inclination angle of the inclined surface 451 relative to the optical axis 456 is not less than the critical angle so as to totally reflect the light. For example, the light guide portion 450 which is integrally molded with the ink container 1 is made of polypropylene having a refractive index of 1.49, the total reflection condition is determined by Snell law of refraction as follows (refractive index of the air is 1):

$$1.49 \sin \Theta = 1.$$

$$\sin \Theta = 1/1.49.$$

$\Theta = 43°$. Therefore, it will suffice if the inclination angle (incident angle=$\Theta$) relative to the optical axis is not less than 43°. In this embodiment, the inclination angle is 45° to satisfy the condition of the total reflection. By doing so, the light guided by the light guide portion 450 is totally reflected by the inclined surface 451 and is directed to the operating portion 3M, so that visibility is improved.

Figure 20:
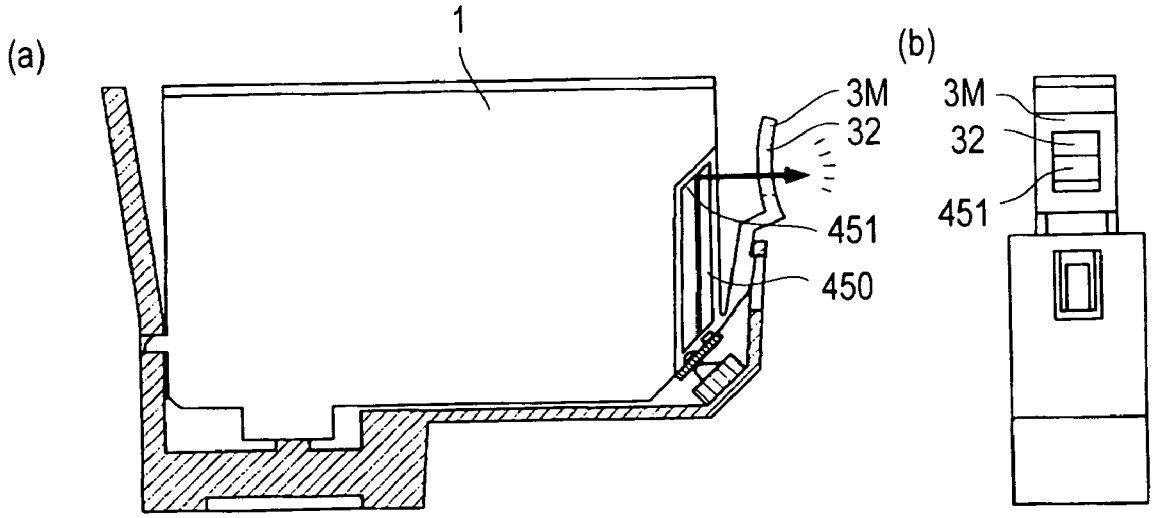
FIG. 20 is a side view (a) and a front view (b) of the side view according to a modified example of the structure of FIG. 18.

FIG. 20 is a side view (a) and a front view (b) of the ink container according to a modified example of the structure of FIG. 18. In this example, the light guide portion 450 is provided by a member separate from the ink container 1. According to this example, the ink container 1 and the light guide portion 450 can be made of suitable materials, respectively. In the case that ink container 1 is not made of a light transmitting material, an opening 32 is formed in a part of the operating portion 3M. Through the opening 32, the reflected light from the inclined surface 451 of the light guide portion 450 is received by the user's eyes.

In the examples of FIG. 18 and FIG. 20, the inclined surface is so set that angle (incident angle) relative to the optical axis guided by the light guide portion 450 is equal to the angle (reflection angle) of reflection toward the operating portion 3M. Then, depending on the materials or the like used, they can be properly set so as to satisfy the total reflection condition.

In order to efficiently reflect the light, the inclined surface may be constituted by a material exhibiting a high refractive index or a high reflectance, for example, metal foil or the like may be stuck.

Moreover, in another alternative, the operating portion 3M of the supporting member does not function as the display portion, but the light guide portion 450 is extended to a position higher than the operating portion similarly to FIG. 16 example, in which the display portion is provided by the top front portion of the light guide portion 450 adjacent the inclined surface portion.

3. Third Embodiment (FIG. 21-FIG. 29)

The user possibly looks at the display portion in various directions depending on the position of the printer or the like, and therefore, it is desirable to emit the light in a wider range from the display portion. On the other hand, the display portion is not only for the user observation but also for the ink container detecting operation and the control operation of the recording device, and therefore, a light receiving portion 210 is provided in the recording device as shown in FIG. 15.

For example, when the carriage 205 scans relative to the light receiving portion 210, the ink containers and/or the display portion passes by the light receiving portion 210 sequentially. During the passage, it can be checked whether the ink containers are mounted at the correct positions, respectively. More particularly, at the timing when a certain ink container is faced to the light receiving portion 210, the emitting portion of the ink container containing the ink of the color, which container is supposed to be placed at the position facing to the light receiving portion 210, is actuated to light the emitting portion on to emit the light from the display portion. If the light receiving portion 210 receives the light, it is discriminated that ink container is mounted at the correct position, if not, the container is mounted at a wrong position. If the latter is the case, the recording operation is prevented, for example, and prompts the user to open the main assembly cover 201 and remount the ink container at the wrong position by flickering the emitting portion or display portion of the wrongly mounted ink container. By doing so, the inconveniences that color reproduction is not proper because of the erroneous mounting of the ink container or containers, and the inconveniences that no warning is provided for the ink container in which the ink is short, and a warning is erroneously provided for the ink container containing a sufficient amount of the ink.

The light receiving portion 210 used for such ink container detection or control is fixed in the apparatus, while the ink container is carried on the carriage and reciprocated, and therefore, the positional relation relative to the display portion of the ink container is constant during the detecting operation. For this reason, it is preferable that display portion emits the light within a small range as long as a proper mounting tolerance of the light receiving portion in the recording device is permitted, so that density of the light quantity directed to the light receiving portion is maintained sufficiently high, as contrasted to the standpoint of observation by the user.

Thus, the display portion is required to satisfy these contradictory functions. The description will be made as to the embodiment which is intended to meet the contradictory requirements.

Figure 21:
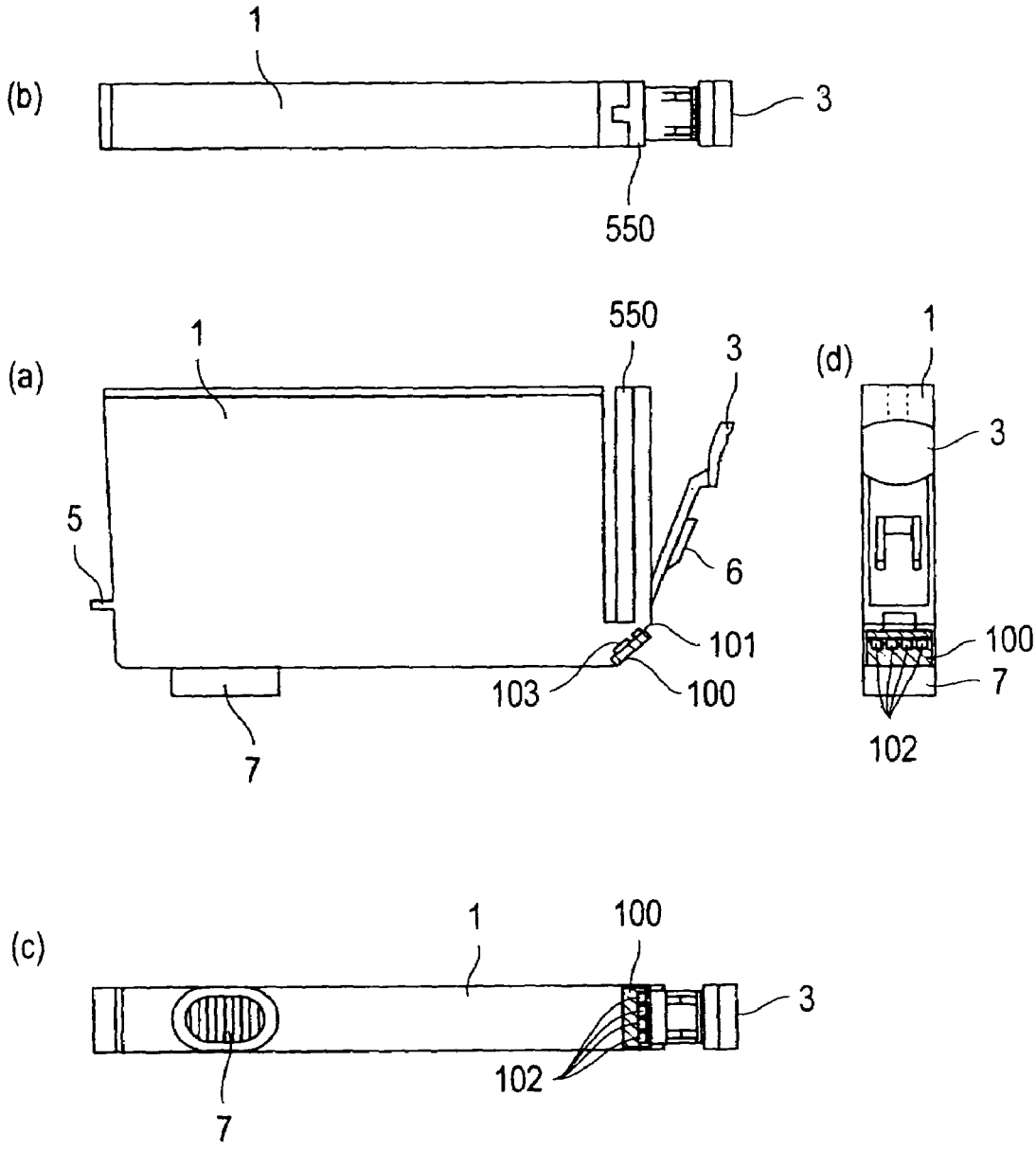
FIG. 21 is a side view (a), a top plan view (b), a bottom view (c) and a front view (d) of an ink container which is a liquid container according to a third embodiment of the present invention.

FIG. 21 is a side view (a), a top plan view (b), a bottom view (c) and a front view (d) of an ink container which is a liquid container according to a third embodiment of the present invention. In these Figures, designated by 550 is a light guide portion (light guide rib). Similarly to the foregoing embodiment, an end surface of the bottom side is erected from a position facing the emitting portion 101.

Figure 22:
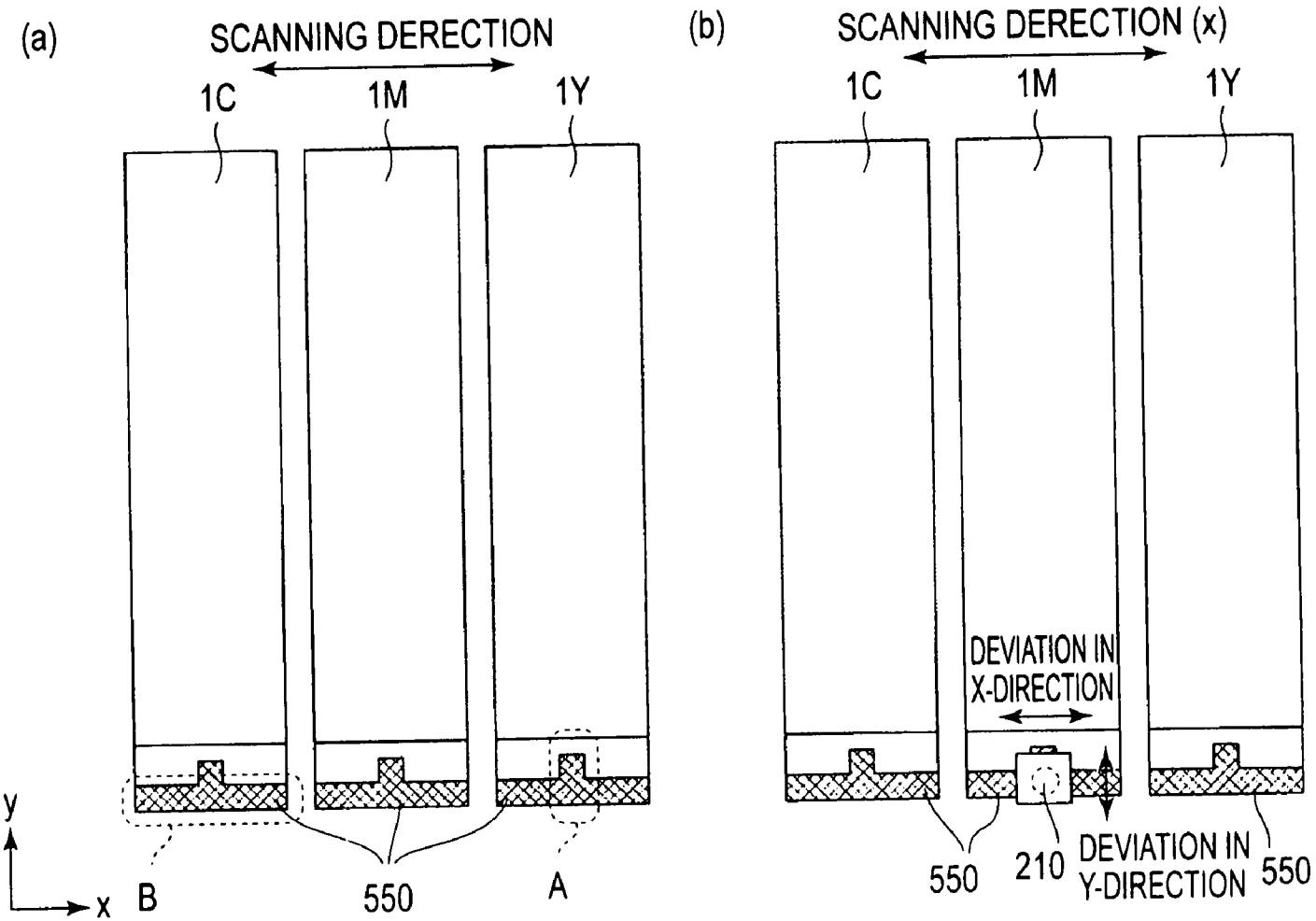
FIG. 22 is a schematic top plan view (a) of a recording device on which a plurality of ink container 1 shown in FIG. 21 are carried, and a schematic view (b) illustrating the ink containers facing the light receiving portion provided at a lower position of the printer, while the carriage is moving.
Figure 23:
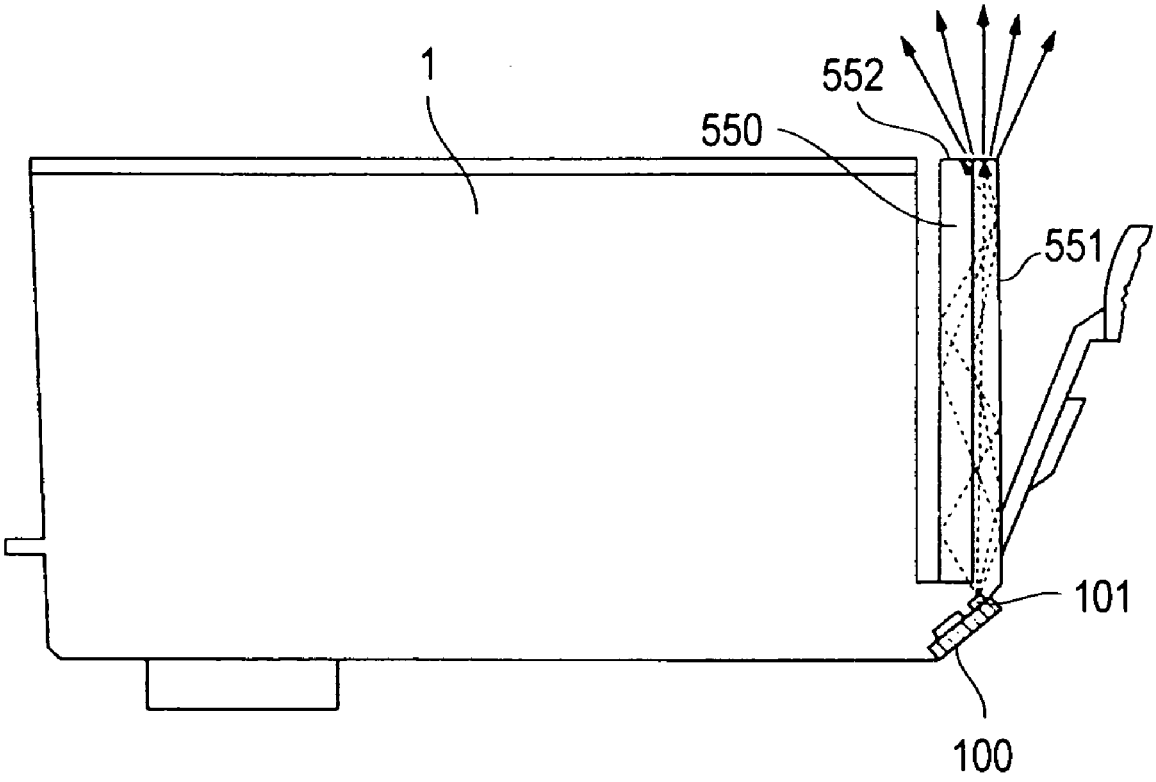
FIG. 23 a schematic side view illustrating functions of a light guide portion of an ink container described in FIG. 22.

Referring to FIG. 22 and FIG. 23, the configuration and the function of the light guide member of the embodiment will be described.

FIG. 22 is a schematic top plan view (a) of a recording device on which a plurality of ink container 1 shown in FIG. 21 are carried, and a schematic view (b) illustrating the ink containers facing the light receiving portion provided at a lower position of the printer, while the carriage is moving, wherein a cyan container 1C, a magenta container 1M and a yellow container 1Y are particularly noted. The ink containers are juxtaposed in the widthwise direction of the ink container, namely, in the moving direction (scanning direction) of the holder 150 or the carriage 205. In (b) of FIG. 22, the plurality of ink containers are faced to the bottom of the light receiving portion 210 (FIG. 15) disposed in the printer, by movement of the carriage. The light guide portion 550 has a substantially T-shaped cross-section as seen from the top (perpendicular to the sheet of the drawing), wherein the T-shaped portion includes a portion (portion B) extending in the scanning direction (left-right direction, x direction in the Figure), and a portion (portion A) projected from a central portion of the portion B in a direction perpendicular to the scanning direction (vertical direction, y direction in the Figure). The light guide portion of this example is in the form of a rod having a T-shaped cross-section.

FIG. 23 a schematic side view illustrating functions of a light guide portion of an ink container described in FIG. 22. This Figure shows the state in which the light emitted by the emitting portion 101 is incident on the light guide portion 550, and guided in the light guide portion 550 to reach the top end portion 552 of the light guide portion, where the light is emergent to the outside, as indicated by arrows 511. In this example, the emitting portion 101 is disposed at a position facing to an intersection between the portion An and the portion B of the T-shaped cross-section at the end of the bottom side of the light guide portion 550, and the light emitted by the emitting portion 101 is directed to the portion An and the portion B of the light guide portion 550.

Here, a relative positional relation of the light receiving portion 210 fixed in the recording device relative to the ink container may vary due to the assembling tolerance of the mounting of the light receiving portion 210. More particularly, referring to FIG. 22, (b), the deviations may arise in the carriage scanning direction (x direction), a perpendicular direction (y direction) perpendicular thereto, and the direction perpendicular to the sheet of the drawing of this Figure (z direction). According to this embodiment, the configuration of the light guide portion 550 permits the deviations in such directions and still permits correct ink container detecting operation for discriminating the properness of the state of the mounting of the ink containers and the properness of the mounting positions thereto.

The deviation in the z direction is influential to the change in the distance from the top end portion 552 to the light receiving portion 210 and therefore influential to the detected intensity of the light from the top end portion 552. However, an appropriate threshold setting can be set to permit the change in the light quantity within the range of the tolerance, so that deviation of the light receiving portion 210 in the z direction is not a problem in the ink container detecting operation.

The deviation in the x direction is acceptable by the light receiving portion 210 continuously receiving the light emergent at the top end portion 552 while scanning the carriage with the emitting portion 101 of the ink container 1 emitting the light. More particularly, even if there is a deviation of the light receiving portion in the x direction, the light emission and the light reception are carried out within the range into which the deviation is taken into account, by which the ink container detecting operation can be properly carried out. The portion A is effective to provide a maximum value (peak value) in a curve of change of the received light quantity of the light receiving portion 210. Therefore, it is possible that in consideration of the point of time of the detection of the peak, the subsequent light emission timing of the emitting portion 101 for the detecting operation may be adjusted, by which the deviation in the x direction is compensated for, in effect.

Furthermore, if the portion A has a length in the y direction, which is not less than the tolerance range of the light receiving portion 210 mounting position in the y direction, the light from the top end portion 552 can be received. By doing so, the deviation of the light receiving portion 210 in the y direction is accepted to such an extent that ink container detecting operation can be carried out correctly. With the decrease of the length of the portion A, the density of the light emergent from the end of the light guide portion 550 increases, so that light quantity received by the light receiving portion 210 increases. By this, the influence of external disturbance is minimized to assure the ink container detecting operation. Thus, the length of the portion A can be properly selected in consideration of the mounting position tolerance of the light receiving portion 210 and the preferable light quantity received by the light receiving portion 210.

On the other hand, the top end portion 552 of the light guide portion (display portion) is lit on or flickered upon shortage of the ink container, for example, and is observed by the user. Therefore, the emergent region is desirably so wide that user can look at it from various positions at various angles. The above-described portion A is effective to permit proper detecting operation of the light receiving portion by selecting the dimension and the configuration. On the other hand, the portion B can provide a sufficiently wide emergent region of the light by selecting the dimension and the configuration. The top end portion 552 of the light guide portion 550 extends also in the widthwise direction of the ink container 1 so that light can be emergent widely in the widthwise direction. By this, the visible area is increased.

In this example, the light guide portion has a T-shaped cross-section. But, this is not limiting, and the configuration of the light guide portion may be different if the configuration and the dimension are so selected that emergent light at the top end portion 552 is enough. The top end portion may be other than the T-shaped.

Figure 24:
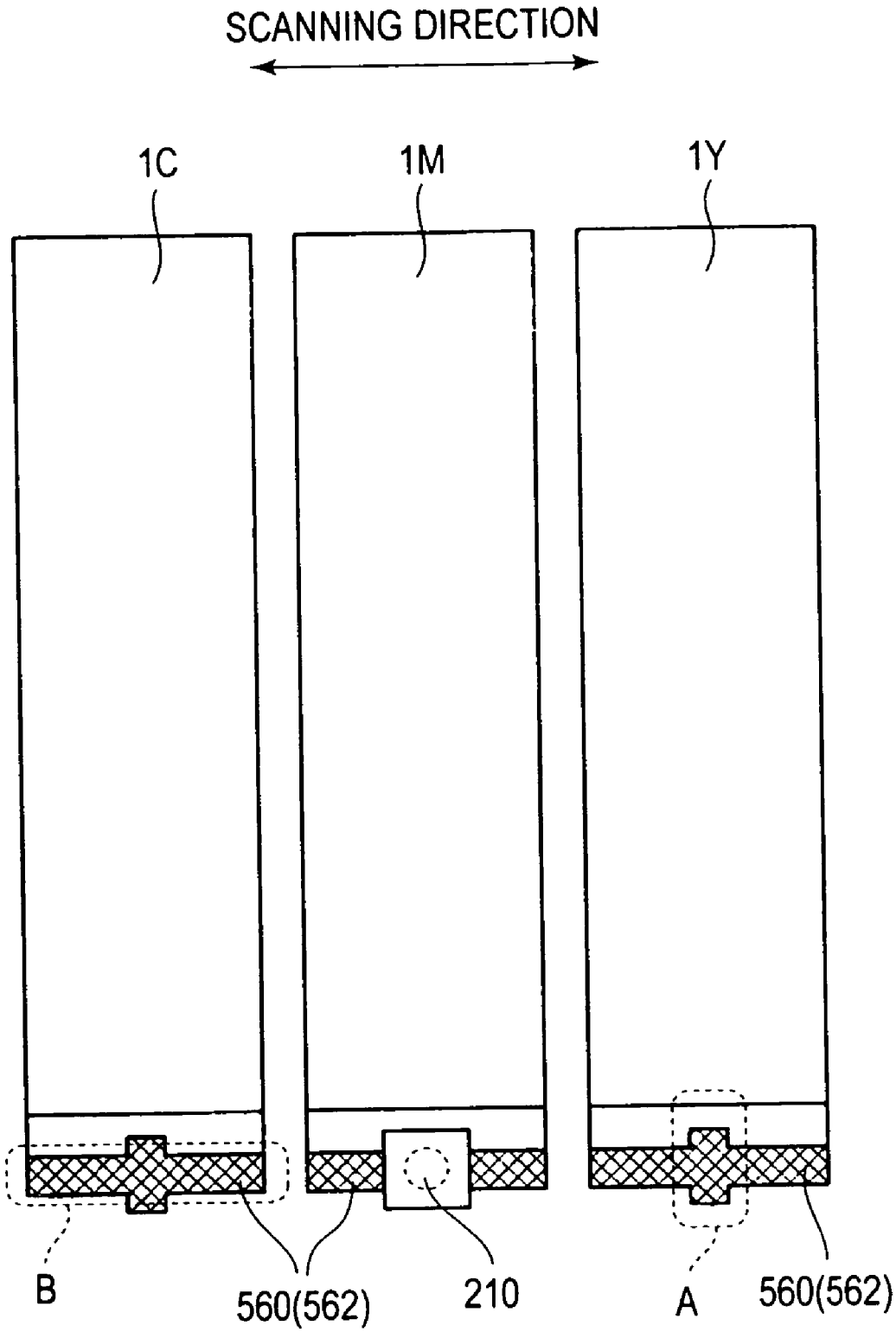
FIG. 24 is a schematic top plan view illustrating another example of a configuration of the light guide portion.

The light guide portion 560 of the example of FIG. 24 has a substantially cross-like configuration comprising a portion (B configuration) extending in parallel with the scanning direction (x direction or left-right direction in the Figure)

and a portion (A configuration) extending perpendicularly to the scanning direction (y direction or up-down direction, as seen from the top side (perpendicularly to the sheet of the drawing). With such a configuration, the similar advantageous effects as with FIG. 22 example can be provided. The deviation in the y direction can be covered by properly selecting the length of the A configuration portion of the light guide portion 560 which extends perpendicularly to the scanning direction (up-down direction in the Figure). More particularly, if the length is not less than mounting position tolerance of the light receiving portion in the y direction, the light can be received at the end of the light guide portion 560. Thus, the deviation of the light receiving portion 210 in the y direction can be permitted, and the position of the ink container can be detected.

Figure 25:
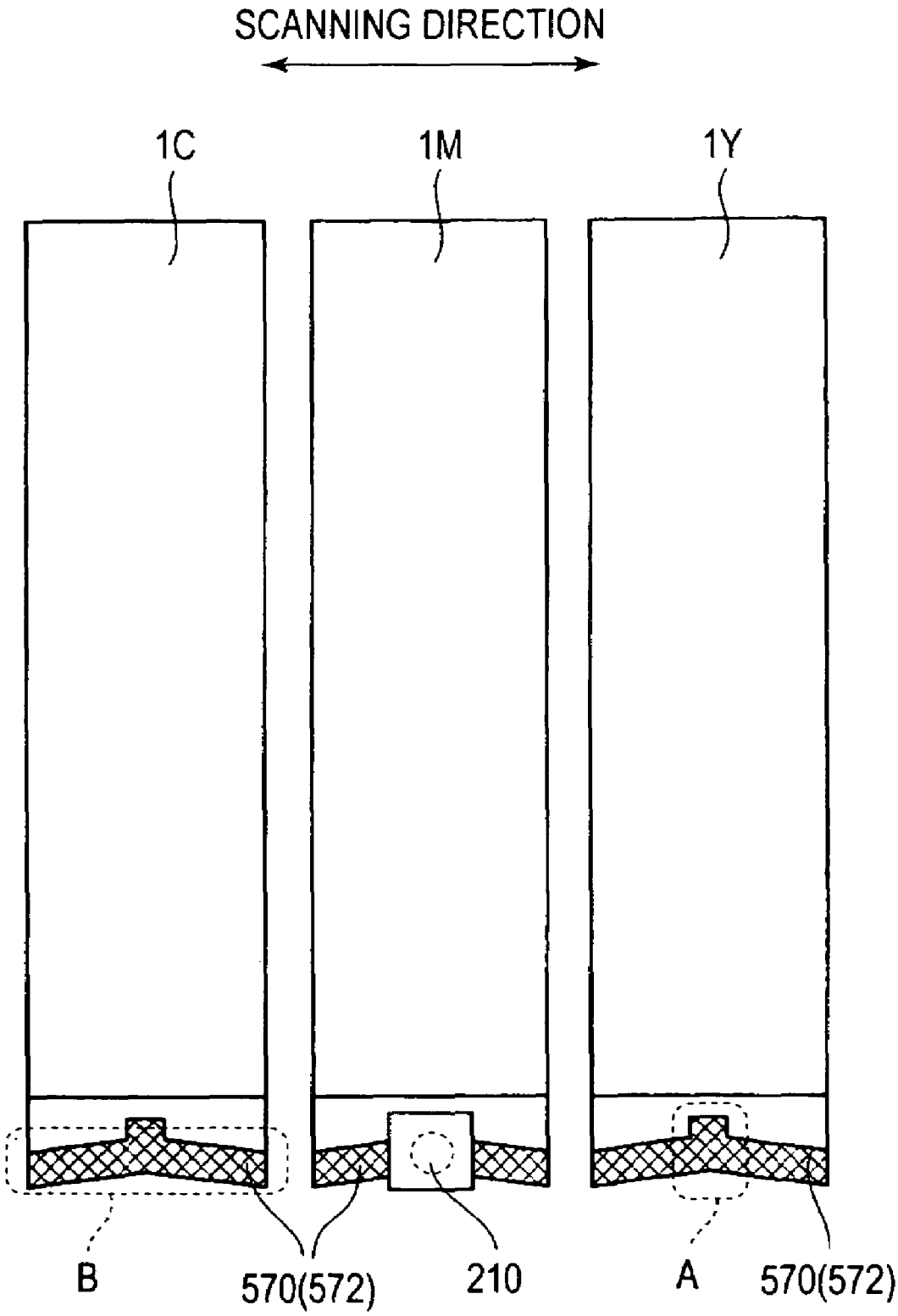
FIG. 25 is a schematic top plan view illustrating a further example of the configuration of the light guide portion.

FIG. 25 is a schematic top plan view of a plurality of ink containers 1 carried on the carriage, the ink containers 1 having light guide portions 560 which are different in configuration at the top end portion 562, and a cyan container 1C, a magenta container 1M and a yellow container 1Y are particularly shown. In this Figure, the light receiving portion is shown as being located at the top end portion of the ink container 1M for the magenta ink.

The light guide portion 560 and/or the top end portion 562 in this example has an arcuate portion (portion B) extending in the scanning direction (x direction, left-right direction in the Figure) and a portion (portion A) extending in the direction perpendicular to the scanning direction (y direction in the Figure, up-down direction) from the central portion of the portion B. These portions constitute substantially Y-shape. With such a configuration, similarly to the foregoing examples, the deviation of the light receiving portion 210 in the x direction, the y direction and the z direction can be permitted, and the detecting operation for the ink containers 1 can be assuredly carried out. The dimensions of the portions can be properly determined by one skilled in the art in consideration of the operation of the light receiving portion and the viewability by the user, similarly to the foregoing examples.

In the third embodiment and the modified examples thereof, the display portion is disposed at the upper end surface of the light guide portion extending substantially upwardly from the portion immediately adjacent the light emitting portion 101. However, similarly to the second embodiment, the display portion can be disposed at another position. Such examples will be described.

Figure 26:
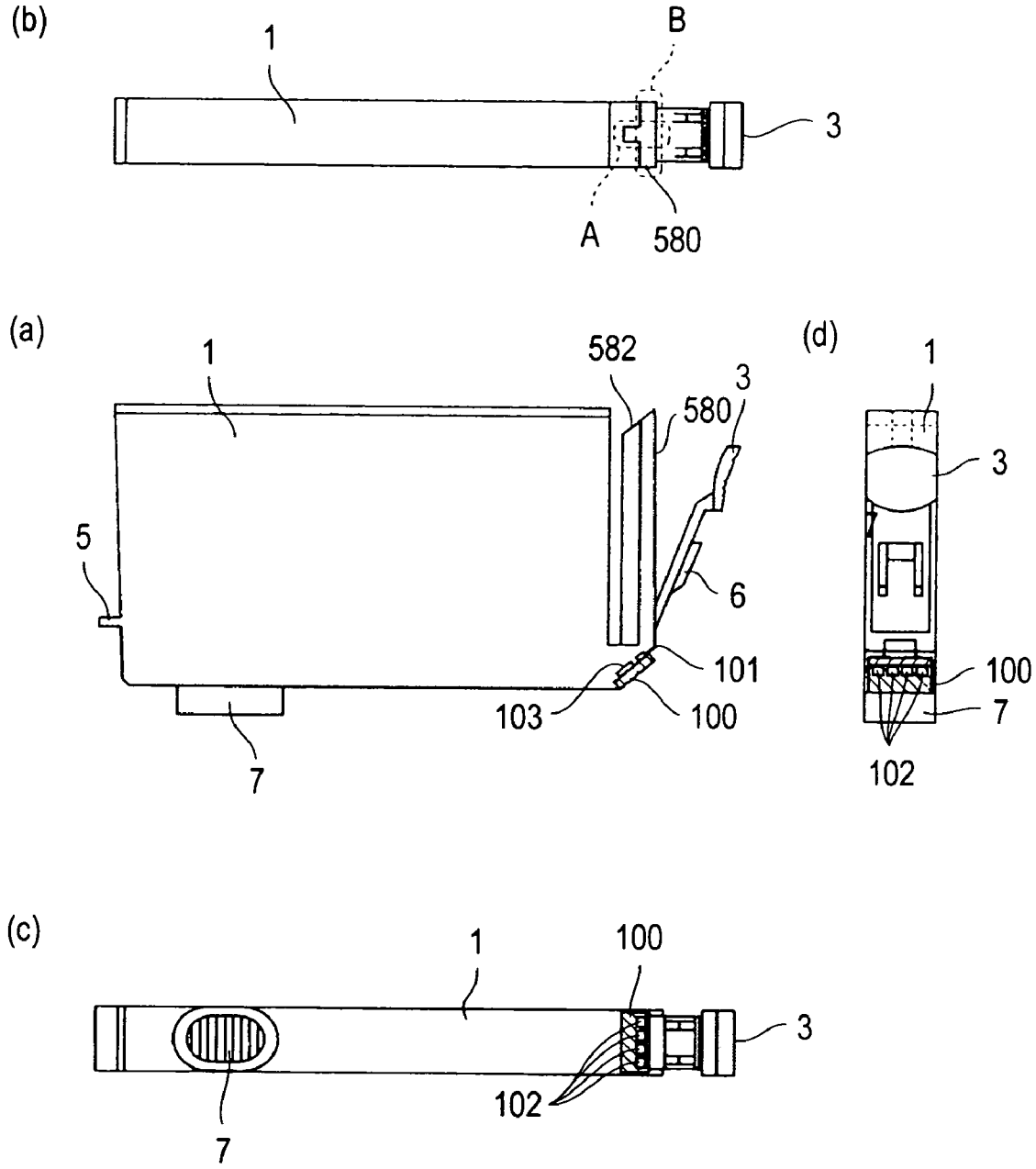
FIG. 26 is a side view (a), a top plan view (b), a bottom view (c) and a front view (d) of an ink container which is a modified example of the embodiment of FIG. 21.
Figure 27:
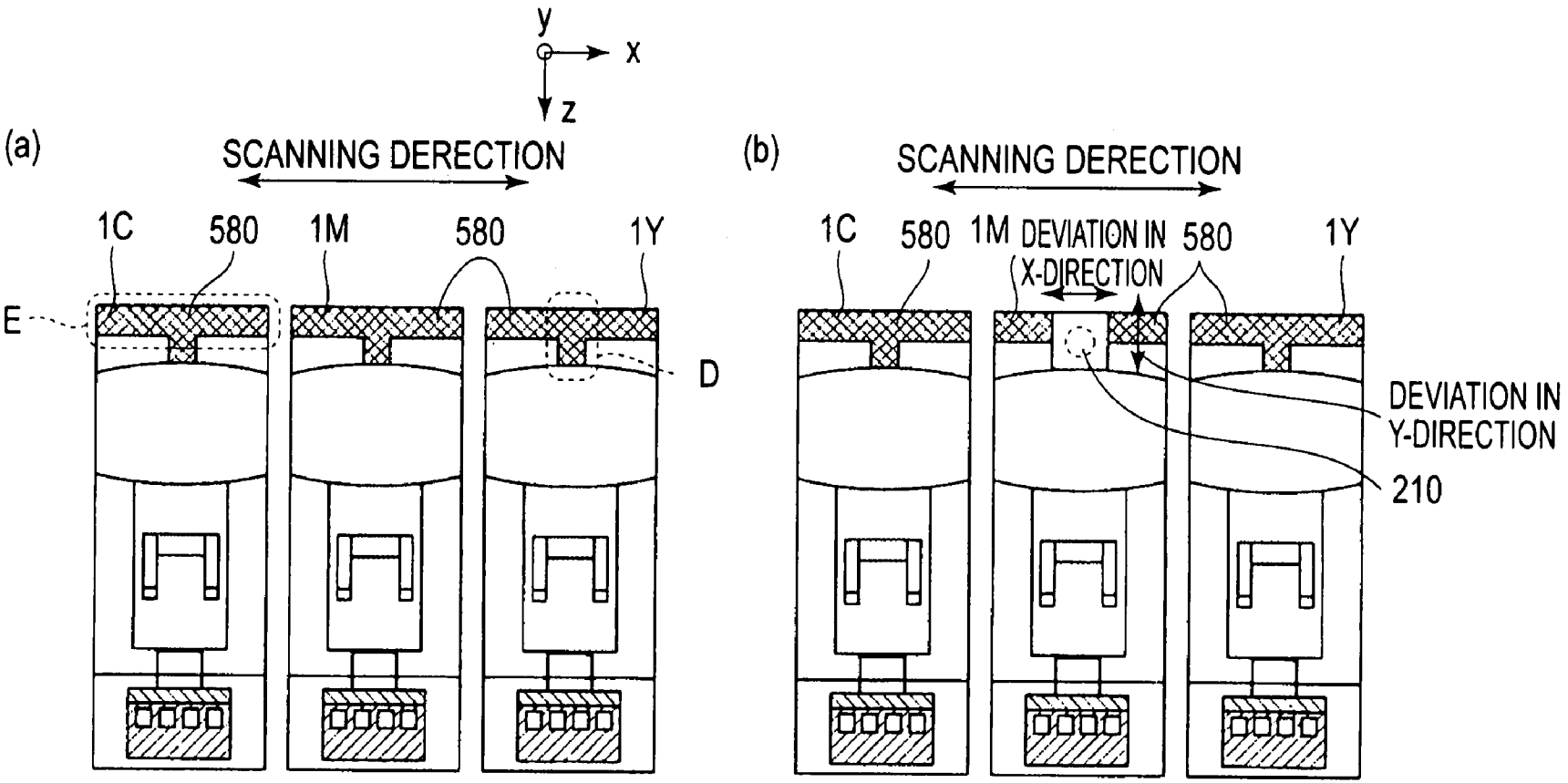
FIG. 27 is a schematic front view (a) of a recording device which carries a plurality of ink containers 1 shown in FIG. 24, and a schematic view (b) illustrating the ink containers facing the light receiving portion provided at a lower position of the printer, while the carriage is moving.
Figure 28:
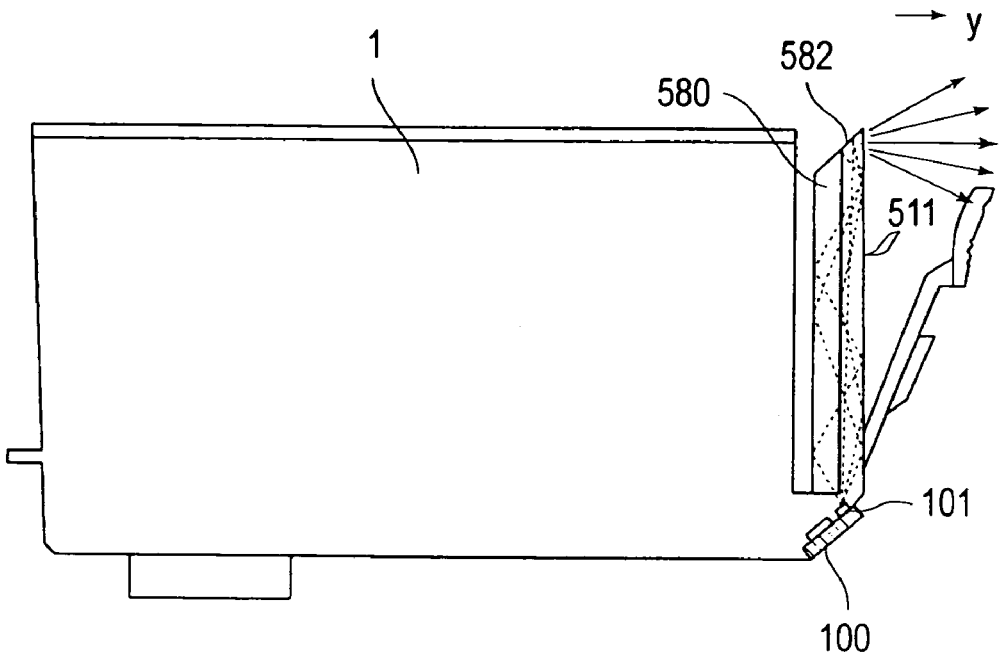
FIG. 28 is a schematic side view illustrating behavior of the beam from the incidence onto the light guide portion to the emergence from the light guide portion shown in FIG. 26, (a).

FIG. 26 is a schematic top plan view illustrating another example of a configuration of the light guide portion. FIG. 27 is a schematic front view (a) of a recording device which carries a plurality of ink containers 1 shown in FIG. 26, particularly, a cyan container 1C, a magenta container 1M and a yellow container 1Y. FIG. 27 is also illustrates at (b) the state in which the light receiving portion is disposed opposed to the display portion of the ink container 1M for the magenta ink in the arrangement of FIG. 27, (a). FIG. 28 is a schematic side view illustrating the function of the light guide portion of this example.

The configuration of the light guide portion 580, similarly to FIG. 22, has a substantially T-shaped cross-section as seen from the top, wherein the T-shaped portion includes a portion (portion B) extending in the scanning direction and a portion (portion A) projected from a central portion of the portion B in a direction perpendicular to the scanning direction. The light guide portion 580 has an inclined surface 582 similar to example of FIG. 18, and in FIG. 27, (a), the light guide portion 580 is cut by the inclined surface 582. The configuration is substantially T-shaped constituted by a portion E extending in the scanning direction (x direction) as seen from the front, and a portion D extending therefrom in a direction perpendicular thereto (vertical direction in (a) of FIG. 27 or z direction).

In FIG. 28, the light emitted by the emitting portion 101 is incident on the light guide portion 580, is guided in the light guide portion 580, is reflected by the inclined surface 582, and is emergent at the front of the front side of the ink container (righthand side in FIG. 28). The inclination angle of the inclined surface 582, similarly to the foregoing, is set not less than critical angle to provide the total reflection of the light guided by the light guide portion 580. If the light guide portion 580 is formed by polypropylene material, for example, it may be approximately 45°. As an alternative, in order to efficiently reflect the light, the inclined surface may be constituted by a member exhibiting a high refractive index or a high reflectance. For example, metal foil or the like may be stuck on the inclined surface 582.

In this example, the light receiving portion 210 is disposed such that emergent light is received at the front side (y direction) not at the upper part (z direction) of the ink container. In such a case, the deviations of the light receiving portion 210 arise in the x, y and z directions, similarly to the foregoing. According to this example, too, the configuration of the light guide portion 550 accommodates the deviations in such directions and still accomplishes the correct ink container detecting operation for discriminating the properness of the state of the mounting of the ink containers and the properness of the mounting positions thereto.

Here, the deviation in the y direction corresponds to the deviation in the z direction in the foregoing example, and is influential to the change in the distance from the emergent position of the light to the light receiving portion 210, but the deviation is acceptable by an appropriate threshold setting to accommodate the change in the light quantity so that correct ink container detecting operation is accomplished.

The deviation in the x direction is the same as the deviation in the x direction in the foregoing example, and can be accepted by the light receiving portion 210 continuously receiving the light of the top end portion 552 while scanningly moving the carriage with the emitting portion 101 of the ink container 1 emitting the light.

Furthermore, the deviation in the z direction corresponds to the deviation in the y direction in the foregoing example. If the length of the portion D measured in the z direction as seen from the front side, is not less than the mounting position tolerance range of the light receiving portion 210 in the z direction, the light from the top end portion 582 can be received, so that mounting of the light receiving portion 210 in the z direction is acceptable, and the positive ink container detecting operation is accomplished.

Similarly to the foregoing example, the dimension, configuration and or the like of the respective portions D or E can be determined in consideration of the operation of the light receiving portion and the user's observation.

Figure 29:
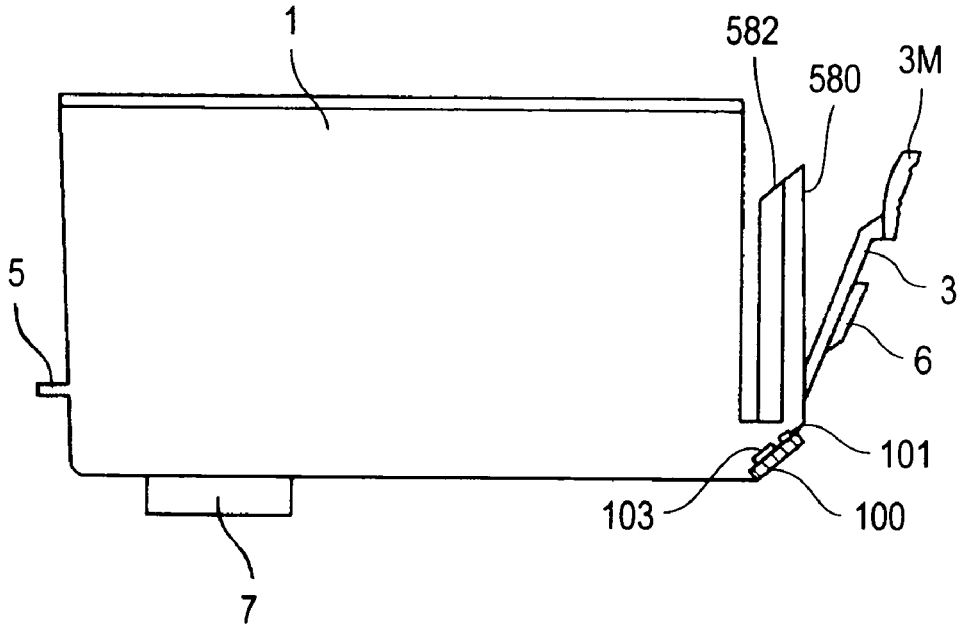
FIG. 29 is a schematic side view of a modified example of an ink container shown in FIG. 26, (a).

In place of providing the display portion by the top front side position of the light guide portion 580 where the light is emergent, the inclined surface 582 is disposed behind the operating portion 3M of the supporting member 3, as shown in FIG. 29, so that operating portion 3M functions as a display portion similarly to the example of FIG. 19. Similarly to the example of FIG. 20, the operating portion 3M may be provided with an opening, through which the reflected light from the inclined surface 582 of the light guide portion 580 can be observed.

4. Fourth Embodiment (FIG. 30)

It is highly desirable that user can correctly determine the ink container from the display portion of which the light is emitted. If the emergent light quantity is too low, it is not easy for the user to detect the light. If, on the other hand, the emergent light quantity is too large, the distinction between adjacent liquid containers is difficult. The same applies to the light receiving portion. More particularly, the light receiving portion might receive the light from an adjacent ink container not the intended ink container.

The description will be made as to an embodiment in which the emergent light from the display portion is properly received by the user and also by the light receiving portion.

Figure 30:
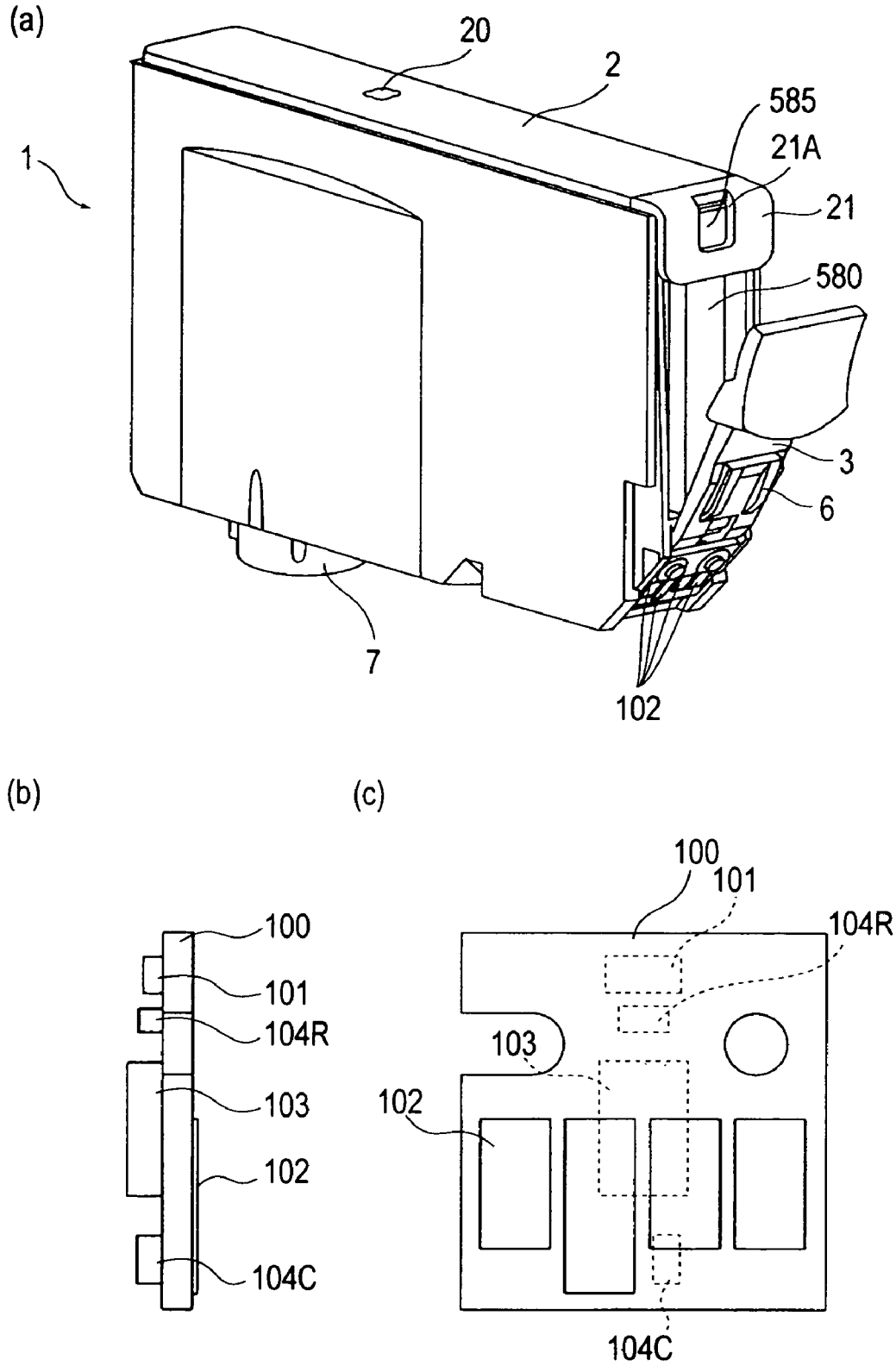
FIG. 30 is a perspective view (a) of an ink container (liquid container) according to a fourth embodiment of the present invention, a side view (b) and a front view (c) of an example of a controller substrate 100 mounted on an ink container.
Figure 31:
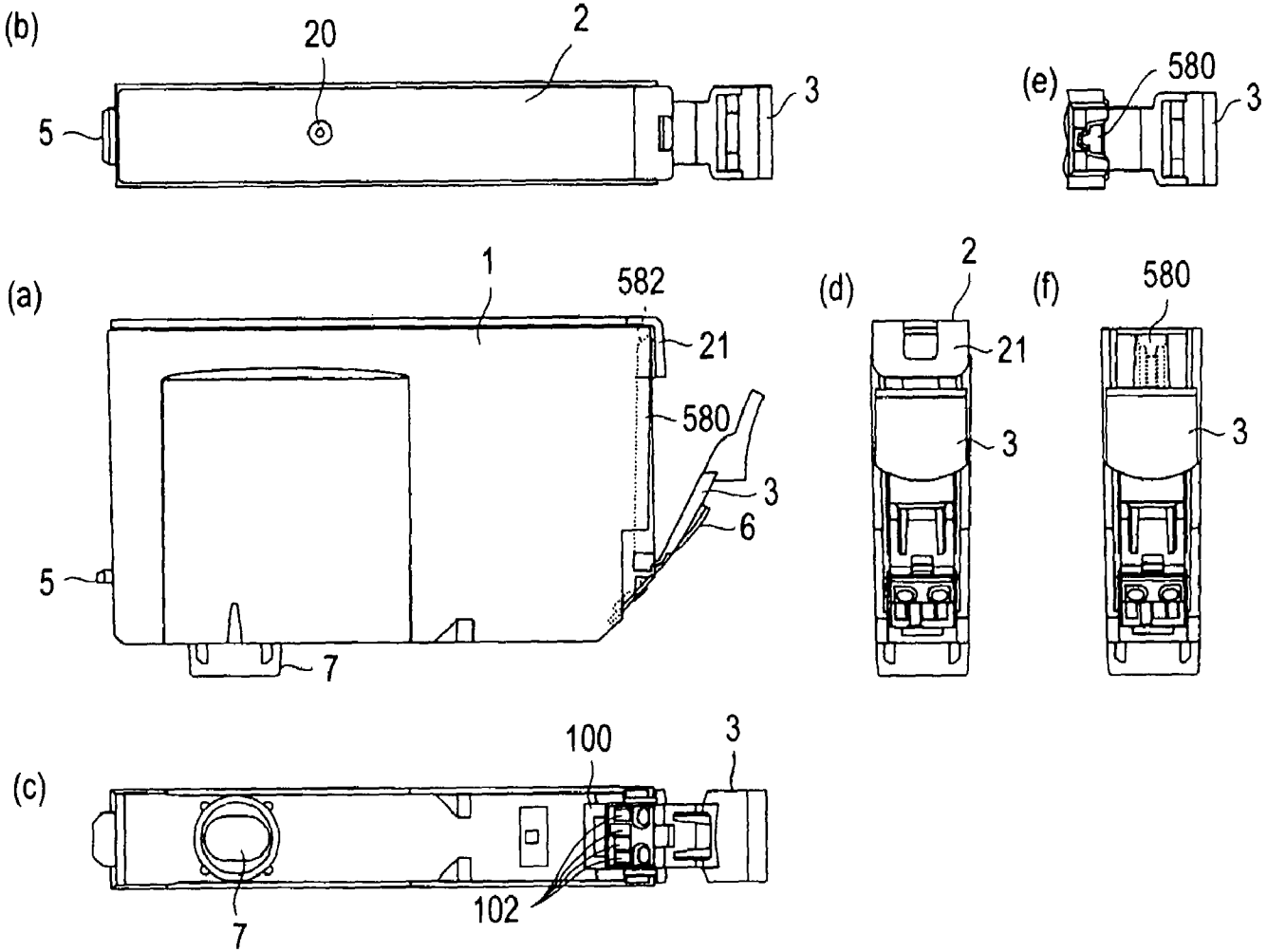
FIG. 31 is a side view (a), a top plan view (b), a bottom view (c) and a front view (d) of the ink container shown in FIG. 28, and a top plan view (e) and a front view (f) of the ink container with the cap member omitted.

FIG. 30 is a perspective view (a) of an ink container which is a liquid container according to a fourth embodiment of the present invention, a side view (b) and a front view (c) of an example of the controller substrate 100 usable with the fourth embodiment. FIG. 31 is a side view (a), a top plan view (b), a bottom view (c) and a front view (d) of the ink container of FIG. 30. FIG. 31 is also a top plan view (e) and a front view of the ink container wherein a cap member is removed.

The structure of this example is basically the same as with FIG. 26. The light guide portion 580 has a substantially T-shaped cross-section and has an inclined surface 582, and is extended up for a position opposed to the emitting portion 101, so that light is emergent from the portion (the portion corresponding to portions D, E in FIG. 27) which is at the top front side and which provides the display portion 585. In this example, a predetermined opening 21A is formed opposed to the display portion 585, and the periphery portion of the display portion 585 is covered so as to limit the emergent direction of the light by an emergent light limitation member 21. As shown in FIG. 30, (b) and (c), the surface of the substrate 100 which faces the inside of the ink container 2, there are provided a light emitting portion 101 (typically a LED) for emitting visible light and a resistor 104R for adjusting the current flowing to the light emitting portion. Furthermore, there are provided a control element 103 for controlling the light emitting portion and a capacitor 104C for stabilizing the voltage applied to the control element, and the control element 103 controls the light emission of the light emitting portion 101 on the basis of the electric signal supplied thereto from the connector 152 through the pad 102. The control element 103, which has been in the form of a control element 103 coated with a protecting sealant, but in this embodiment, it is in the form of a package coated with a resin material, for example. The region package has a function of protecting the control element 103 similarly to the sealant, and another material is usable if the same function can be performed. Similarly to FIG. 2, (b), a memory element for storing information such as a color of the ink or the remaining ink amount may be in the package.

Designated by reference numeral 2 is a cap member which is mounted to the upper side of the ink container 1 to cover the inside and which has an air vent 20 for fluid communication between the inside and the ambience. In this example, the emergent light limiting member 21 is made of thermoplastic elastomer, for example, by which it can be welded on the cap member 2 to provide an integral member. Since the thermoplastic elastomer is transparent, it may be colored so as to reduce the emergent light at the periphery portion to stabilize the receiving operation of the light receiving portion 210 and improvement in the user visibility. Or, a material other than elastomer is usable, and it may be integrally molded with the cap member 2 by the same material. When the cap member 2 is made of a transparent material, the emergent light may be limited by unsmoothing at least one of the front and back surfaces of the portion constituting the emergent light limitation member 21, or the surface may be subjected to a blast treatment.

According to this embodiment, the emergent light from the display portion is appropriately limited, by which the light quantity can be made preferable for both of the user visibility and operation stabilization of the light receiving portion. The light guide portion is not limited to those described hereinbefore, and the configuration may be different from that of FIG. 24. The display portion may be formed at the upper end surface of the light guide portion.

5. Others

The fundamental concept of the present invention is applicable to an ink container not having a light emitting portion as described above.

Figure 32:
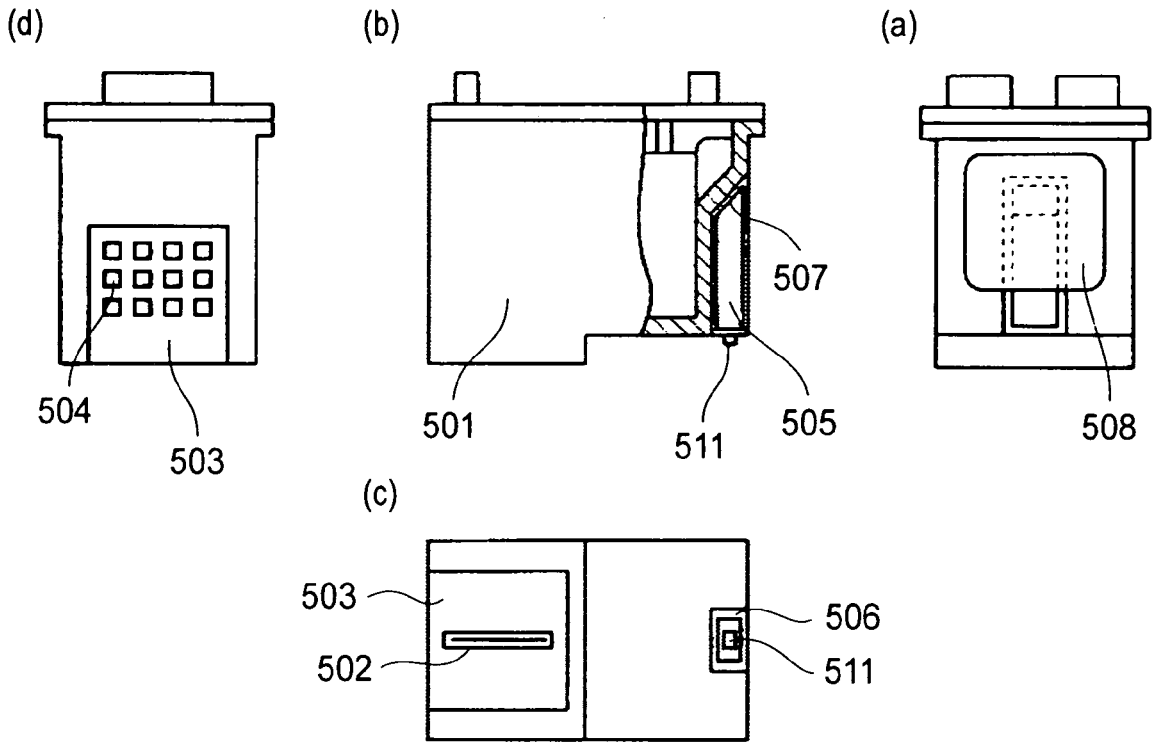
FIG. 32 is a front view (a), a partly broken side view (b), a bottom view (c) and a rear view (d) of an example of an ink container according to a further embodiment of the present invention.

FIG. 32 is a front view (a), a partly broken side view (b), a bottom view (c) and a rear view (d) of an example of an ink container of such embodiments. A recording head 502 is disposed at a bottom side of ink container 501, and is electrically connected with a wiring portion 503 constituted by TAB or the like, and is electrically connected with an electrical contact on a carriage provided in the printer through an electrical contact portion 504 of the wiring portion 503 on the rear side of the ink container 501. A recess is formed in a front side of the ink container 501, and a light guide portion 505 is disposed therein. The printer is provided with a light source 511 such as LED at a position close to the incident surface 506 which is a bottom side of the light guide portion 505, in the state of the ink container 501 is mounted to the printer. On the other hand, a top end of the light guide portion 505 is provided with an inclined surface 507, which is covered by film or the like, thus constituting a display portion 508.

In the recording head 502, discriminating information of the ink container 501 is stored. When the ink container 501 is mounted on the printer, the discriminating information is read in by the printer through the wiring portion 503. The printer stores the information relating to the ink container correspondingly to the discriminating information of the ink container 501, and the emission control of the light source 511 is executed on the basis of the stored information.

Therefore, the light emitted by the light source is incident on the light guide portion 505 through the incident surface 506, and is guided from the bottom side to the upper side. The light guided to the inclined surface 507 reflected toward the front side by the inclined surface 507, and is directed to the display portion 508 disposed at the front side of the ink container 501, by which the light can be received by the user.

With such a structure, when one of the ink container becomes empty, for example, a setting operation is executed such that incident surface 506 of the light guide portion of the ink container faces the light source, and then the light source 511 is actuated. In this manner, the notification is accomplished by the display portion 508.

The present invention is applicable to an ink container non-removably integral with a recording head. In such a case, if the mounting position is not correct, the desired recording quality is not provided because the received data are for different color, or because the order of the layers of the applied inks are different from the intended one.

The present invention is applicable to the case wherein the ink containers are mounted at fixed positions which are away from the recording head carried on the carriage. For example, the recording heads are connected with the respective fixed ink containers through flexible tubes to supply the ink into the recording heads (continuous supply type), wherein the light guide portion of any one of the foregoing embodiments is used with the fixed ink container. In such a case, the fixed ink container is disposed in the scanning range of the carriage, for example, a light receiving portion which is subjected to the detecting and/or controlling operation by the apparatus side may be provided on the carriage.

Such a structure is not limited to the use with the continuous supply type using a tube. It is usable with a type wherein a recording head is provided with an ink storing portion having a relatively small amount of ink, and the ink storing portion is supplied with ink from an ink supplying source having a relatively large capacity (fixed ink container) intermittently at appropriate timing. In one of such a type, the fixed ink container is physically connected with the ink supply system only when the ink is supplied from the supplying source. When the tube is used, a valve or the like may be used to selectively open or close the ink supply path.

In the foregoing embodiments, the description has been made with the ink containers containing yellow ink, magenta ink, cyan ink and black ink. However, the used color or color tone is not limited However, the used color or color tone is not limited to these examples, and the number of the ink containers is not limited to those of the examples. In addition to such inks, special color ink such as light color ink, red ink, green ink, blue ink or the like is usable. With the increase of the number of the ink containers, the liability of the erroneous mounting of the ink container increases, and the visibility and/or mounting and demounting property is deteriorated by the increasing wiring lead and connecting portions, so that effectiveness of the present invention increases.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 306128/2004 and 371495/2004 filed Oct. 20, 2004 and Dec. 22, 2004, respectively, which are hereby incorporated by reference.

What is claimed is:

1. A liquid container for accommodating liquid for use with an ink jet recording apparatus, said container comprising:

a light emitting portion;

an electric contact for receiving a signal for actuating said light emitting portion from the ink jet recording apparatus; and a light guide portion for guiding the light from said light emitting portion to a display portion which displays information by the light which is emitted from said light emitting portion and which emerges from said display portion.

2. A container according to claim 1, wherein a space is provided between said light guide portion and an accommodating portion for accommodating the liquid.

3. A container according to claim 1, wherein a member of a material having a refractive index lower than that of material of said light guide portion or a reflection member for reflecting the light is disposed between said light guide portion and an accommodating portion for accommodating the liquid.

4. A container according to claim 1, wherein said light guide portion is integrally molded from a transparent resin material.

5. A container according to claim 1, wherein said light guide portion is demountably integral with said accommodating portion.

6. A container according to claim 1, wherein said light guide portion has a portion for bending an optical axis toward said display portion.

7. A container according to claim 6, wherein said bending portion is a curved portion of said light guide portion.

8. A container according to claim 6, wherein said bending portion is an inclined surface of said light guide portion provided at an end thereof opposite from an end for receiving the light from said light emitting portion.

9. A container according to claim 1, wherein a part of said light guide portion constitutes said display portion.

10. A container according to claim 1 and wherein said display portion is disposed at an operating portion for receiving a mounting operation of said liquid container to the ink jet recording apparatus.

11. A container according to claim 1, wherein said light guide portion comprises a part extending in a predetermined direction and a part extending in a direction different from the predetermined direction.

12. A container according claim 11, wherein said light emitting portion is capable of emitting the light at the crossing portion.

13. A liquid container according to claim 11, wherein said ink jet recording apparatus includes means for imparting a relative movement between said liquid container and a light receiving portion for receiving the light emergent from said display portion, and wherein the scanning direction is the same as the predetermined direction.

14. A liquid container according to claim 1, wherein said liquid container contains the liquid which is ink.

15. An ink jet recording apparatus comprising a light receiving portion capable of facing said display portion, and liquid container according to claim 14, as an ink supply source.

* * * * *